US005857168A

United States Patent [19]

Ozawa

[11] Patent Number: 5,857,168

[45] Date of Patent: Jan. 5, 1999

[54] METHOD AND APPARATUS FOR CODING SIGNAL WHILE ADAPTIVELY ALLOCATING NUMBER OF PULSES

[75] Inventor: Kazunori Ozawa, Tokyo, Japan

[73] Assignee: NEC Corporation, Tokyo, Japan

[21] Appl. No.: 840,318

[22] Filed: Apr. 14, 1997

[30] Foreign Application Priority Data

Apr. 12, 1996 [JP] Japan ..... 8-115678

[51] Int. Cl.[6] ..... G10L 7/00

[52] U.S. Cl. ..... 704/229; 704/219

[58] Field of Search ..... 704/223, 219, 704/222, 200, 216, 229, 220, 230

[56] References Cited

U.S. PATENT DOCUMENTS

| | | | |
|---|---|---|---|
| 5,170,396 | 12/1992 | Rivers et al. | 371/6 |
| 5,208,862 | 5/1993 | Ozawa | 704/216 |
| 5,261,027 | 11/1993 | Taniguchi et al. | 704/200 |
| 5,598,504 | 1/1997 | Miyano | 704/222 |
| 5,682,407 | 10/1997 | Funaki | 375/240 |
| 5,687,284 | 11/1997 | Serizawa et al. | 704/222 |

FOREIGN PATENT DOCUMENTS

| | | | |
|---|---|---|---|
| A0525809 | 2/1993 | European Pat. Off. | H04B 1/66 |
| 4171500 | 6/1992 | Japan | G10L 9/18 |
| 4363000 | 12/1992 | Japan | G10L 9/18 |
| 5-6199 | 1/1993 | Japan | G10L 9/18 |
| WO96 01527 | 1/1996 | WIPO | H03M 7/00 |

OTHER PUBLICATIONS

M.R. Schroeder et al., "Code–Excited Linear Prediction (CELP): High–quality Speech At Very Low Bit Rates", *Proceedings ICASSP, 1985*, pp. 937–940.

W.B. Kleijn et al., "Improved Speech Quality and Efficient Vector Quantization in SELP", *Proceedings ICASSP*, 1988, pp. 155–158.

M. Yong et al., "Subband Vector Excitation Coding with Adaptive Bit–Allocation", *Proceedings ICASSP*, 1989, pp. 743–746.

T. Nomura et al., "LSP Coding Using VQ–SVQ with Interpolation in 4.075 KBPS M–LCELP Speech Coder", *Proceeding Mobile Multimedia Communications*, 1993, pp. B.2.5–1 to B.2.5–4.

J.D. Johnston, "Transform Coding of Audio Signals Using Perceptual Noise Criteria", *IEEE Journal on Selected Areas in Communications*, vol. 6, No. 2, Feb. 1988, pp. 314–323.

P.O. Vaidyanathan, "Multirate Digital Filters, Filter Banks, Polyphase Networks, and Applications: A Tutorial", *Proceedings of the IEEE*, vol. 78, No. 1, Jan. 1990, pp. 56–93.

P. Kroon et al., "Pitch Predictors with High Temporal Resolution", *Proceedings ICASSP*, 1990, pp. 661–664.

C. Laflamme et al., 16 KBPS Wideband Speech Coding Technique Based On Algebraic CELP, *Proceedings ICASSP*, 1991, pp. 13–16.

Y. Linde et al., "An Algorithm for Vector Quantizer Design", *IEEE Transactions on Communications*, vol. COM–28, No. 1, Jan. 1980, pp. 84–94.

"Signal Analysis and System Identification", by Corona–sha, 1988, pp. 82–87.

N. Sugamura et al., "Speech Data Compression by LSP Speech Analysis synthesis Technique", *Japanese Telecommunication Institute J64–A*, 1981, pp. 599–606.

*Primary Examiner*—Richemond Dorvil

*Attorney, Agent, or Firm*—Sughrue, Mion, Zinn, Macpeak & Seas, PLLC

[57] ABSTRACT

A signal coding apparatus includes a signal dividing section for dividing an input signal in units of frames and in units of bands, a pulse allocating section for determining a performance request value for each of the bands, for determining a number of pulses for each of the bands from the performance request value for the band, and for adaptively allocating the determined numbers of pulses to the bands for every frame, and a plurality of coding circuits respectively provided for the bands. Each of said plurality of coding circuits generates a transmission signal for a corresponding band for every frame based on the number of pulses allocated to the corresponding band.

25 Claims, 20 Drawing Sheets

METHOD AND APPARATUS FOR CODING SIGNAL WHILE ADAPTIVELY ALLOCATING NUMBER OF PULSES

BACKGROUND OF THE INVENTION

1. Field of the Invention

The present invention relates to a method and apparatus for coding a signal in which signals such as a speech signal and a music signal can be coded with a low bit rate with high quality.

2. Description of the Related Art

As a conventional system capable of coding a speech signal with a high efficiency, there is known a code excited linear prediction coding (CELP) system in which an excitation signal is expressed by vector-quantized noise, as described in, for instance, "Code-excited Linear Prediction: High Quality Speech at very low bit rates" written by M. Schroeder and B. Atal, (Proceedings ICASSP, pages 937 to 940, 1985: reference No. 1), and "Improved Speech Quality and Efficient Vector Quantization in SELP" written by Kleijn et al., (Proceedings ICASSP, pages 155–158, 1988: reference No. 2).

In this conventional CELP system, a spectral parameter indicative of the spectral characteristic of the speech signal is extracted from the speech signal for every frame having a time period of, for example, 20 ms by using the linear prediction coding (LPC) analysis on the transmission side. Each of the frames is further subdivided into a plurality of sub-frames each of which has for example, a time period of 5 ms, and a parameter in an adaptive code book is extracted for every sub-frame based upon a past excitation signal. This parameter is composed of a delay parameter corresponding to a pitch period and a gain parameter. The pitch of the speech signal in the sub-frame is predicted by using an adaptive code book. As to this pitch-predicted excitation signal, an optimum excitation signal code vector is selected from an excitation signal code book (vector-quantized code book) which is composed of preselected kinds of noise signal, and then an optimum gain is calculated to thereby quantize the excitation signal.

An excitation signal vector is selected to minimize error power between a signal synthesized from the selected noise signal and the remaining signal. Then, the index for indicating the kind of selected code vector, the gain, and also the spectral parameter are combined with the parameter of the adaptive code book by a multiplexer and transmitted to a signal decoder side. The explanations about the signal decoder side are omitted.

Also, another conventional system which is based on the CELP system is known in the field. In the other conventional system, an input signal is subdivided into a plurality of bands (namely, sub-bands), and the CELP coding is carried out for every sub-band in order to properly process not only speech signals, but also signals such as music signals having irregularly changeable characteristics. This conventional system is described in, for example, "Subband vector excitation coding with adaptive bit allocation" by M. Yong et al., (Proceedings ICASSP, pages 743–746, 1989: reference No. 3).

In the conventional system disclosed in the reference No. 3, an input signal having the bandwidth of 8 kHz is subdivided into two sub-bands: a sub-band 1 having the bandwidth of 0 to 2 kHz, and a sub-band 2 having the bandwidth of 2 to 4 kHz. Thereafter, a prediction remaining power is calculated based on respective sub-band input signals.

Further, the ratio of the prediction remaining power is calculated between the sub-bands. Then, the number of quantization bits required for the coding operation in each of the sub-bands are adaptively allocated.

In the above-described conventional systems, there is a problem that a large amount of calculations are necessarily required so as to select the optimum excitation signal code vector from the excitation signal code book. This is because in the above-described systems of the references No. 1 and No. 2, each of these code vectors is once filtered or convoluted, and this calculation is repeatedly carried out plural times equal to the quantity of code vectors stored in the code book when the optimum excitation signal code vector is selected. For example, if the number of bits of the code book is assumed to be "B" bits and the number of dimensions is selected to be "N", and if the filter response length of filtering or the impulse response length of convolution calculation is assumed to be "K", the calculation amount of $N \times K \times 2^B \times 8000/N$ is required per 1 second. As one example, if B=10, N=4, and K=10, then 81,920,000 calculations are required per second. This may cause such a problem that the total calculation amount becomes very large.

Moreover, in the conventional system described in the reference No. 3, in the case that the number of quantization bits required for coding are allocated between the sub-bands, the allocation of the number of bits is performed based on the prediction remaining power in each of the sub-bands to carry out the coding of a signal.

As a consequence, in this conventional system, the above-described allocation of the number of bits is not performed in order that the actually required coding performance is satisfied so as to represent the excitation signal in each of the sub-bands. Accordingly, this conventional system could not represent sufficiently good sound qualities for signals such as music signals having irregularly changeable characteristics other than speech signals.

Moreover, when the excitation signal is expressed by using, for example, a combination of a plurality of pulses other than a content of the code book in order to reduce the total calculation amount, the above-mentioned allocation of the number of bits could not be properly matched to a total quantity of pulses.

SUMMARY OF THE INVENTION

The present invention is made in the light of the above circumstances. Therefore, an object of the present invention is to provide a signal coding method and apparatus in which the above problems can be solved and a signal can be coded with good quality in a relatively small calculation quantity.

Another object of the present invention is to provide a signal coding method and apparatus in which the number of pulses can be adaptively allocated to each of bands of a signal.

In order to achieve an aspect of the present invention, a signal coding apparatus includes a signal dividing section for dividing an input signal in units of frames and in units of bands to generate a frame signal for each frame and for the bands and a band frame signal for each frame and for each band, a pulse allocating section for determining a performance request value for each of the bands and a band control signal from the frame signal, for determining a number of pulses for each of the bands from the performance request value for the band, and for adaptively allocating the determined numbers of pulses to the bands for every frame, and a plurality of coding circuits respectively provided for the bands, wherein each of the plurality of coding circuits generates a transmission signal for a corresponding band for every frame from the band frame signal and the band control signal based on the number of pulses allocated to the corresponding band.

In this case, the pulse allocating section may include a spectral parameter section for calculating a first spectral parameter of the frame signal, quantizing the spectral parameter of the frame signal to determine an index of the quantized spectral parameter, and for inversely quantizing the quantized spectral parameter to generate a second spectral parameter, an impulse response calculating section for calculating first to third impulse responses from the first and second spectral parameters, and for supplying the band control signal generated from the first and second impulse responses to each of the plurality of coding circuits, a performance calculating section for calculating a performance request value for each of the bands from the third impulse response as an impulse response of a synthesis filter, and an allocating section for determining the numbers of pulses for the bands from the performance request values for the bands to adaptively and respectively allocate the number of pulses to the plurality of coding circuits for every frame.

In this case, the pulse allocating section may further include an interpolating circuit for interpolating the first and second spectral parameters supplied from the spectral parameter section for every sub-frame which is shorter than a length of one frame to supply to the impulse response calculating circuit. Also, the impulse response calculating section may include an impulse response calculating circuit for generating the first to third impulse responses from the first and second spectral parameters, and a dividing circuit for generating the band control signal for each of the bands from first and second impulse responses as impulse responses of perceptually weighting filters from the impulse response calculating section to output to each of the plurality of coding circuits corresponding to the band. Alternatively, the impulse response calculating section may include an impulse response calculating circuit for generating the first to third impulse responses from the first and second spectral parameters, a dividing circuit for generating first and second band impulse response for each of the bands from first and second impulse responses as impulse responses of perceptually weighting filters from the impulse response calculating section, and an LPC analysis circuit for receiving the first and second band impulse responses from the dividing circuit to calculate auto-correlation function values and for calculating first and second linear prediction coefficients from the auto-correlation function values the band control signal.

The allocating section may include a table for storing a data indicating a relation of the performance request value and the number of pulses, and an allocating circuit for referring to the table in accordance with the performance request value for each of the bands supplied from the performance calculating section to determine the number of pulses for each of the bands, and for determining and allocating the optimal numbers of pulses for the bands to the plurality of coding circuits.

When the signal coding apparatus further includes a mode determining section for extracting a feature of the frame signal from the frame signal supplied from the signal dividing section to determine one of modes, the pulse allocating section determines a performance request value for each of the bands and a band control signal from the frame signal, determines a number of pulses for each of the bands from the performance request value for the band and the determined mode, and adaptively allocates the determined numbers of pulses to the bands for every frame.

In this case, the allocating section may include a plurality of tables respectively provided for the modes, wherein each of the plurality of tables stores a data indicating a relation of the performance request value and the number of pulses, and an allocating circuit for selecting one of the plurality of tables in accordance with the determined mode, for referring to the selected table in accordance with the performance request value for each of the bands supplied from the performance calculating section to determine the number of pulses for each of the bands, and for determining and allocating the optimal numbers of pulses for the bands to the plurality of coding circuits.

Each of the plurality of coding circuits includes a perceptual weighting circuit for perceptually weighting a corresponding band frame signal in accordance with the band control signal to produce a perceptually weighting signal, a response signal calculating circuit for receiving indexes of a gain and delay of an adaptive code book, indexes of amplitudes and positions of an excitation signal, an index of a gain code book and the band control signal to calculates a drive excitation signal and to calculate a response signal from the drive excitation signal, a subtracter for subtracting the response signal supplied from the response signal calculating circuit from the perceptually weighting signal to produce a subtracted signal, an adaptive code book circuit for receiving the subtracted signal from the subtracter, the drive excitation signal from the response signal calculating circuit, and the band control signal to determine an index indicating a delay and to perform a pitch prediction for determining a prediction remaining signal, an excitation signal calculating circuit for determining the amplitudes and positions of the excitation signal from the prediction remaining signal supplied from the adaptive code book circuit and the band control signal in accordance with the number of pulses allocated to the band to generate the indexes of the amplitudes and positions of the excitation signal, a gain code book for storing gain code vectors, and a gain quantizing circuit for receiving the subtracted signal from the subtracter, the prediction remaining signal from the adaptive code book circuit, the amplitudes and positions of the excitation signal from the excitation signal calculating circuit, and the band control signal to refer to the gain code book for determining the index of the gain of the gain code book and the index of the gain of the adaptive code book, and for supplying the indexes of the gain and delay of the adaptive code book, the indexes of the amplitudes and positions of the excitation signal, and the index of the gain of the gain code book.

In order to achieve another aspect of the present invention, a signal coding apparatus includes a signal dividing section for dividing an input signal in units of frames and in units of bands to generate a band frame signal for each frame and for each band, a pulse allocating section for determining a performance request value for each of the bands from a band impulse response for each of the band, for determining a number of pulses for each of the bands from the performance request value for the band, and for adaptively allocating the determined numbers of pulses to the bands for every frame, and a plurality of coding circuits respectively provided for the bands, wherein each of the plurality of coding circuits generates a transmission signal for a corresponding band for every frame and the band impulse response for the corresponding band from the band frame signal based on the number of pulses allocated to the corresponding band.

In this case, each of the plurality of coding circuits includes a spectral parameter section for calculating a first spectral parameter of the frame signal, quantizing the spectral parameter of the frame signal to determine an index of the quantized spectral parameter, and for inversely quantizing the quantized spectral parameter to generate a second spectral parameter, an impulse response calculating section for calculating the band impulse response and a band control signal from the first and second spectral parameters, a perceptual weighting circuit for perceptually weighting a corresponding band frame signal in accordance with the first and second spectral parameters to produce a perceptually weighting signal, a response signal calculating circuit for calculating a second response signal from a first response signal, and the first and second spectral parameters, a subtracter for subtracting the second response signal supplied from the response signal calculating circuit from the perceptually weighting signal to produce a subtracted signal, an adaptive code book circuit for receiving the subtracted signal from the subtracter, a drive excitation signal, and the band control signal to determine an index indicating a delay and to perform a pitch prediction for determining a prediction remaining signal, an excitation signal calculating circuit for determining the amplitudes and positions of the excitation signal from the prediction remaining signal supplied from the adaptive code book circuit and the band control signal in accordance with the number of pulses allocated to the band to generate the indexes of the amplitudes and positions of the excitation signal, a gain code book for storing gain code vectors, a gain quantizing circuit for receiving the subtracted signal from the subtracter, the prediction remaining signal from the adaptive code book circuit, the amplitudes and positions of the excitation signal from the excitation signal calculating circuit, and the band control signal to refer to the gain code book for determining the index of the gain of the gain code book and the index of the gain of the adaptive code book, and for supplying the indexes of the gain and delay of the adaptive code book, the indexes of the amplitudes and positions of the excitation signal, and the index of the gain of the gain code book, and a weighting signal calculating circuit for receiving indexes of the gain and delay of the adaptive code book, the indexes of amplitudes and positions of the excitation signal, the index of the gain code book and the first and second spectral parameters to calculates the drive excitation signal and to calculate the first response signal from the drive excitation signal.

Each of the plurality of coding circuits may further include an interpolating circuit for interpolating the first and second spectral parameters supplied from the spectral parameter section for every sub-frame which is shorter than a length of one frame to supply to the impulse response calculating circuit.

In this case, the pulse allocating section includes a band synthesizing section for synthesizing the band impulse responses over the bands to generate a synthesis signal, a performance calculating section for calculating a performance request value for each of the bands from the synthesis signal, and an allocating section for determining the numbers of pulses for the bands from the performance request values for the bands to adaptively and respectively allocate the number of pulses to the plurality of coding circuits for every frame.

In this case, the allocating section may include a table for storing data indicating a relation of the performance request value and the number of pulses, and an allocating circuit for referring to the table in accordance with the performance request value for each of the bands supplied from the performance calculating section to determine the number of pulses for each of the bands, and for determining and allocating the optimal numbers of pulses for the bands to the plurality of coding circuits.

When each of the plurality of coding circuits further comprises mode determining section for extracting a feature of the frame signal from the frame signal supplied from the signal dividing section to determine one of modes, the pulse allocating section determines the performance request value for each of the bands from the band impulse response for each of the band, determines the number of pulses for each of the bands from the performance request value for the band and the determined mode for each of the band, and adaptively allocates the determined numbers of pulses to the bands for every frame. In this case, the pulse allocating section may include a band synthesizing section for synthesizing the band impulse responses over the bands to generate a synthesis signal, a performance calculating section for calculating a performance request value for each of the bands from the synthesis signal, and an allocating section for determining the numbers of pulses for the bands from the performance request values for the bands to adaptively and respectively allocate the number of pulses to the plurality of coding circuits for every frame. Also, the allocating section include a plurality of tables respectively provided for the modes, wherein each of the plurality of tables stores data indicating a relation of the performance request value and the number of pulses, and an allocating circuit for selecting one of the plurality of tables in accordance with the determined mode, for referring to the selected table in accordance with the performance request value for each of the bands supplied from the performance calculating section to determine the number of pulses for each of the bands, and for determining and allocating the optimal numbers of pulses for the bands to the plurality of coding circuits.

In order to achieve still another aspect of the present invention, a method of coding an input signal, includes the steps of:

dividing an input signal in units of frames and in units of bands to generate a band frame signal;

determining a performance request value for each of the bands to determine a number of pulses for each of the bands from the performance request value for the band;

adaptively allocating the determined numbers of pulses to the bands for every frame; and generating a transmission signal for a corresponding band for every frame from the band frame signal based on the number of pulses allocated to the corresponding band.

DETAILED DESCRIPTION OF THE PREFERRED EMBODIMENTS

The signal coding apparatus of the present invention will be described below in detail with reference to the accompanying drawings.

Figure 1:
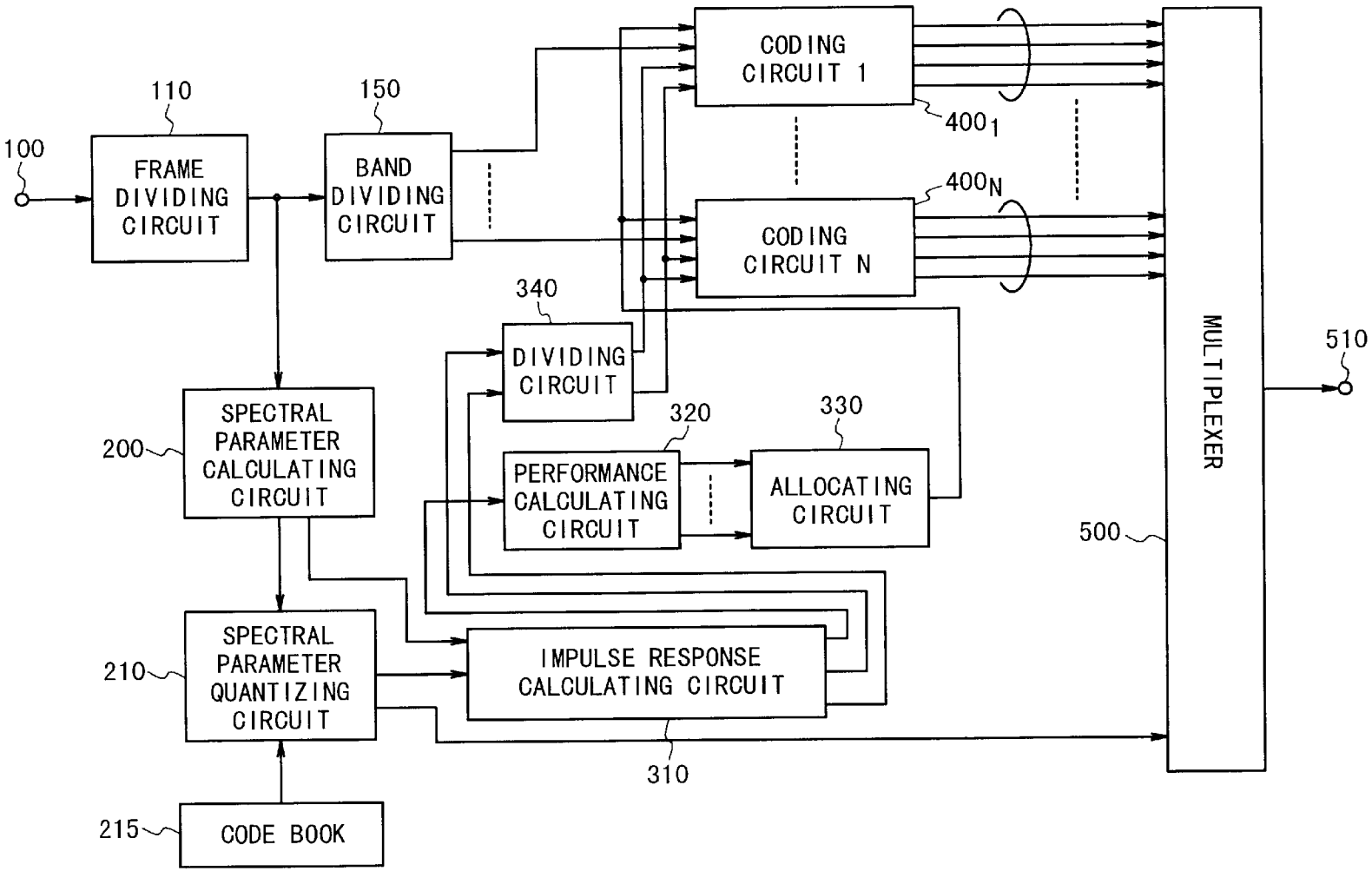
FIG. 1 is a block diagram illustrating a signal coding apparatus according to the first embodiment of the present invention.

First, the signal coding apparatus according to the first embodiment of the present invention will be described below. FIG. 1 is a schematic block diagram for showing a signal coding apparatus according to the first embodiment mode of the present invention. In the first embodiment of the present invention, an input signal is divided into a plurality of bands for every predetermined frame. A spectral parameter (for example, LPC coefficients) representative of a spectral envelop is calculated from the input signal (200 in FIG. 1). A performance request value is determined for each of the bands based on the spectral parameter (320 in FIG. 1). The number of pulses used to represent an excitation signal is adaptively allocated to each of the bands in accordance with the performance request value. The pulses representative of the excitation signal are calculated in a coding section (400 in FIG. 1) in accordance with the number of pulses for performing the coding operation, and an output of a spectral parameter quantizing means (210 in FIG. 1) and an output signal of the coding means 400 are combined and outputted from a multiplexer 500.

More particularly, referring now to FIG. 1, a signal is entered from an input terminal 100, and this input signal is divided for every frame having a time period of, for instance, 20 ms by a frame dividing circuit 110.

A spectral parameter calculating circuit 200 sets up a window of, for example, 24 ms for the input signal of each of the frames to thereby cut out a signal, and then calculates a spectral parameter by preselected orders (for instance, up to 16-th order). It should be noted that the linear prediction coding (LPC) analysis and the Burg analysis well known in the field may be employed in calculating of the spectral parameter. In this embodiment, the Burg analysis is employed. A detailed content of this Burg analysis is described in Japanese publication entitled "SIGNAL ANALYSIS AND SYSTEM IDENTIFICATION" written by Nakamizo, issued in 1988 by Corona-sha, (pages 82 to 87: reference No. 4), and therefore explanations thereof are omitted.

Also, the spectral parameter calculating circuit 200 converts the linear prediction coefficient "$\alpha_i$" (i=1, . . . , 10) as the spectral parameter calculated by the Burg analysis method into an LSP parameter which is suitable for quantization and interpolation, and then outputs the converted LSP parameter to the spectral parameter quantizing circuit 210 and an impulse response calculating circuit 310. It should be noted that the converting technique from the linear prediction coefficient to the LSP parameter is described in, for instance, "Speech Data Compression by LSP Speech Analysis-Synthesis Technique" by Sugamura et al., (Japanese Telecommunication Institute J64-A, pages 599 to 606, 1981: reference No. 5).

In the spectral parameter quantizing circuit 210, the LSP parameter is effectively quantized by using a spectral parameter quantizing code book 215. The quantization is carried out to output quantized values such that distortion given by the following equation (1) is minimized.

$$D_j = \sum_{i}^{P} W(i)\,[LSP(i) - QLSP(i)_j]^2 \tag{1}$$

where symbols LSP(i), $QLSP(i)_j$, and W(i) indicate an i-th order LSP before being quantized, a j-th order LSP after being quantized, and a weight coefficient, respectively. As a method for vector-quantizing an LSP parameter, the well known methods may be utilized. As a specific vector-quantizing method, the multi-stage split vector method is known in which a plurality of stages of vector quantizing units are connected. See the following references for the vector-quantizing method, namely, Japanese Laid-open Patent Application (Heisei 4-171500: Japanese Patent Application No. 2-297600: reference No. 6), Japanese Laid-open Patent Application (Heisei 4-363000: Japanese Patent Application No. 3-261925: reference No. 7), Japanese Laid-open Patent Application (Heisei 5-6199: Japanese Patent Application No. 3-155049: reference No. 8), "LSP Coding Using VQ-SVQ With Interpolation in 4.075 kbps M-LCELP Speech Coder" by T. Nomura et al., (Proceeding Mobile Multimedia Communications, 1933, pp. B2.5 reference No. 9).

Also, the spectral parameter quantizing circuit 210 converts the quantized LSP into linear prediction coefficients $\alpha_i'$ (i=1, . . . , P), and then outputs these linear prediction coefficients to an impulse response calculating circuit 310. Also, this spectral parameter quantizing circuit 210 outputs an index indicative of the quantized LSP to the multiplexer 500.

The impulse response calculating unit 310 calculates three kinds of impulse response for predetermined points. The first impulse response is an impulse response "$h_w(n)$" of a perceptual weighting and synthesizing filter in which z-transform is expressed by the following equation (2).

$$H_w(z) = \left[ \frac{1 - \sum_{i=1}^{P} \alpha_i z^{-i}}{1 - \sum_{i=1}^{P} \alpha_i \gamma^i z^{-i}} + \frac{1}{1 - \sum_{i=1}^{P} \alpha'_i \gamma^i z^{-i}} \right] \quad (2)$$

The second impulse response is an impulse response W(n) of a perceptual weighting filter in which z-transform is expressed by the following equation (3).

$$W(z) = \frac{1 - \sum_{i=1}^{P} \alpha_i z^{-i}}{1 - \sum_{i=1}^{P} \alpha_i \gamma^i z^{-i}} \quad (3)$$

The third impulse response is an impulse response h(n) of a synthesizing filter in which z-transform is expressed by the following equation (4).

$$H(z) = \frac{1}{1 - \sum_{i=1}^{P} \alpha'_i z^{-i}} \quad (4)$$

The first and second impulse responses $h_w(n)$ and w(n) are outputted to a dividing circuit 340, and the third impulse response, i.e., the impulse response h(n) of the synthesizing filter is outputted to a performance calculating circuit 320.

The performance calculating circuit 320 enters the third impulse response h(n) and calculates the number of pulses to be allocated to each of a plurality of bands as a performance request value. The calculated performance request values are then outputted to coding circuits $\mathbf{400}_1$ to $\mathbf{400}_N$.

In this example, as the performance request value, a signal-to-masking threshold ratio (SMR) is used. Another value may be used as the performance request value. This SMR is analogically equivalent to a ratio of a signal having a certain level to a perceptual masking level caused by this signal. Specifically speaking, the following operations are executed.

That is, fast Fourier transform (FFT) processing is executed to the impulse response h(n) with respect to predetermined points L, and then a power spectral density $A_t(k)$ is calculated in accordance with the following equation (5).

$$A_t(k) = 10 \log_{10} \left[ \frac{1}{L(Re^2(Y(k)) + Im^2(Y(k))]} \right] \quad (5)$$

$$(K = 0, \ldots, (L/2) - 1) \text{ (dB)}$$

where the symbol Y(k) indicates a spectrum obtained by performing the FFT processing to the third impulse response h(n), and the symbols Re(·) and Im(·) represent a real part of Y(k) and an imaginary part thereof, respectively. With use of this power spectral density, the following calculation is made of a minimum masking threshold value $LT_{min}(t)$ (dB) with respect to each of the bands.

$$LT_{min}(t) = \min_{t_1 \leqq i \leqq t_2} [LT_{tg}(i)] \text{ (dB)} \quad (6)$$

where the symbols $t_1$ and $t_2$ show a starting edge number of a band "t" and an ending edge number thereof, respectively.

Subsequently, a calculation is made of a signal-to-masking ratio SMR(t) for the band "t" based upon the following equation (7).

$$SMR(t) = L_{sb}(t) - LT_{min}(t) \text{(dB)} \quad (7)$$

where the symbols $L_{sb}(t)$, $LT_{min}$ represent a sound pressure level and a minimum masking threshold value in the band "t", respectively. Also, the symbol $L_{sb}(t)$ is calculated by the following equation (8).

$$L_{sb}(t) = 10 \log_{10} \left[ \sum_n x_t^2(n) \right] \text{ (dB)} \quad (8)$$

The value of SMR(t) calculated for each band "t" as the performace request value is supplied to an allocating circuit 330. In order to perform the calculation of the masking threshold value, the following reference No. 10 could be referred to, i.e., "Transform Coding of Audio Signal using Perceptual Noise Criteria" by J. Johnston, (IEEE Journal on Selected Areas in communications, vol. 6, pages 314–323, 1988: reference 10).

The allocating circuit 330 adaptively allocates the number of pulses to the band "t" in accordance with the determined SMR(t) of the band "t". As a simple allocation example, assuming now that the coding S/N (signal-to-noise ratio) per 1 pulse is A [dB], SMR(t) is divided by A, so that the necessary number of pulses may be calculated.

As described above, the allocated number of pulses is calculated for each of the bands, and then is outputted to the corresponding one of the coding circuits $\mathbf{400}_1$ to $\mathbf{400}_N$ in the above-described manner.

It should be noted that when the allocation of the numbers of pulses is carried out, the numbers of transfer bits are summed over all the bands to calculate a total number of transfer bits B, and the allocated numbers of pulses are adjusted so as to satisfy B=R, where the symbol "R" indicates a predetermined transfer rate. Also, the following equation (9) is satisfied.

$$B = \sum_{i=t}^{N} b(t) \quad (9)$$

where the symbol "b(t)" indicates the number of transfer bits for the band "t" calculated from the allocated number of pulses for the band "t" and other transfer bit information, and the symbol "N" represents the number of bands.

The dividing circuit 340 enters therein the first and second impulse responses $h_w(n)$ and w(n) from the impulse response calculating circuit 310, and then calculates impulse responses of filters for performing band separation by convolution operations of the first and second impulse responses to thereby determine the impulse responses for the respective bands. The determined impulse responses are supplied to the coding circuits 400 ($\mathbf{400}_1$ to $\mathbf{400}_N$), respectively.

It should also be noted that the QMF (quadrature mirror filter) known as the band separating filter can be used. The structure of this QMF filter is described in, for instance, "Multirate digital filters, filter banks, polyphase networks, and applications: A tutorial" by P. Vaidyanathan, Proceedings, (IEEE, vol. 78, pages 56–93, 1990: reference No. 11).

It is now assumed that the first impulse response for the band "t" is expressed as "$h_{wt}(n)$", and the second impulse response for the band "t" is expressed as "$w_t(n)$". Since the coding circuits 400$_1$ to 400$_N$ may perform the same operation for the corresponding bands, only the coding circuit 1 400$_1$ will be described as the typical coding circuit.

Figure 2:
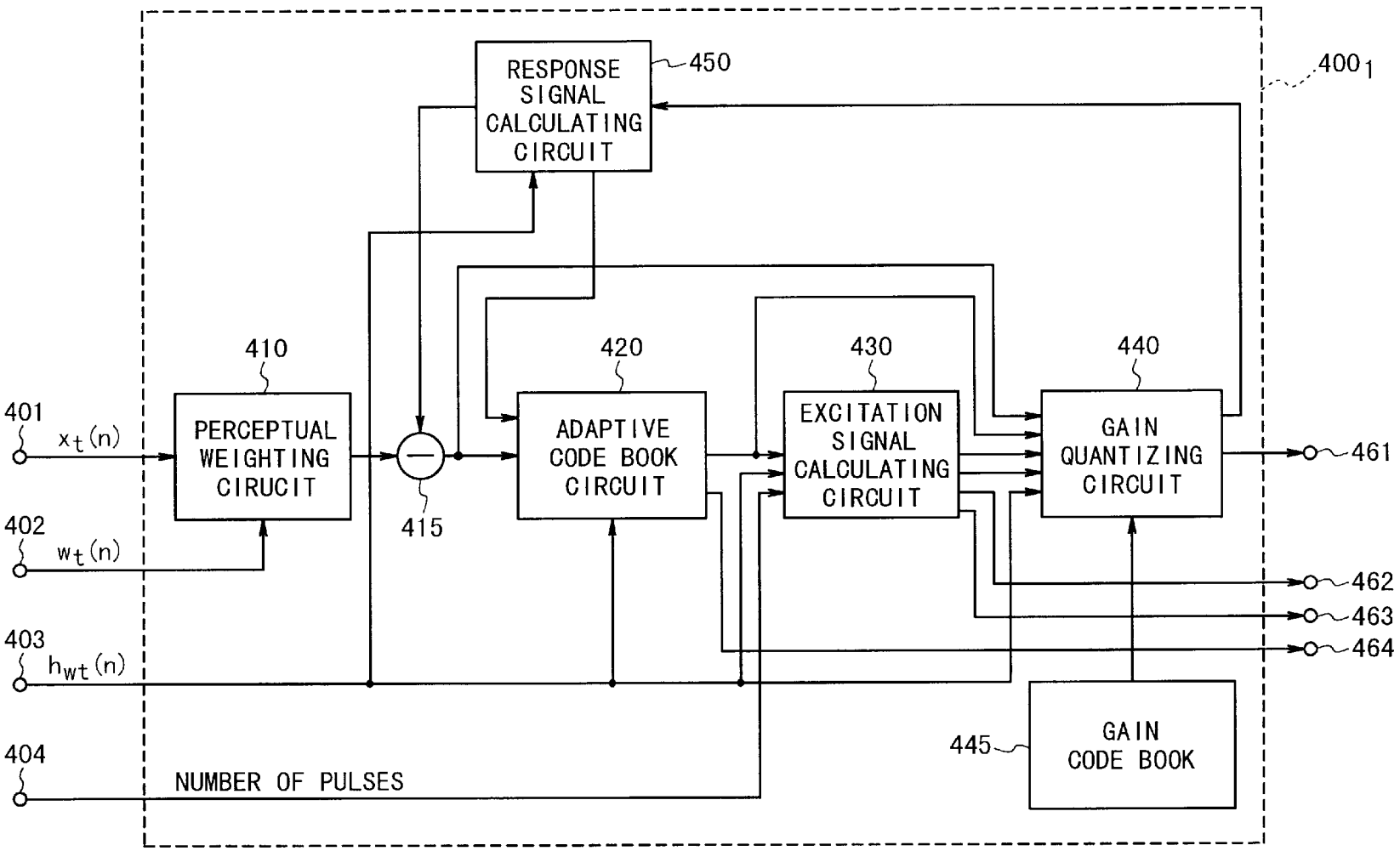
FIG. 2 is a block diagram illustrating a coding circuit $\mathbf{400}_1$ of the signal coding apparatus according to the first embodiment of the present invention.

FIG. 2 is a schematic block diagram for illustrating the structure of the coding circuit 1 400$_1$. Referring to FIG. 2, an input signal $x_t(n)$ for the band "t", the second impulse response $w_t(n)$, the first impulse response $h_{wt}(n)$, and the allocated number of pulses for the band "t" are entered from input terminals 401, 402, 403, and 404, respectively. The imput signal $x_t(n)$ is obtained by dividing a frame signal in units of bands by a band dividing circuit 150 shown in FIG. 1. The frame signal is obtained by dividing the input signal in units of frames by the frame dividing circuit 110 shown in FIG. 1.

Referring to FIG. 2, a perceptual weighting circuit 410 calculates a perceptually weighted signal $x_{wt}(n)$ based on the input signal $x_t(n)$ for the band "t" supplied from the band dividing circuit 150 via the terminal 401 and the second impulse response $w_t(n)$ supplied from the dividing circuit 340 via the terminal 402 in accordance with the following equation (10).

$$x_{wt}(n)=x_t(n)*w_t(n) \tag{10}$$

where the symbol "*" denotes a convolution calculation.

A subtracter 415 subtracts a response signal $X_{zt}(n)$ supplied from a response signal calculating circuit 450 from the perceptually weighted signal $x_{wt}(n)$ as an output of the perceptual weighting circuit 410.

The response signal calculating circuit 450 receives indexes of gain and delay of an adaptive code book, indexes of amplitudes and positions of an excitation signal, an index of gain code vector from a gain quantizing circuit 440, reads out a code vector in accordance with the received indexes, and calculates a drive excitation signal $v_t(n)$ based on the following equation.

$$v_t(n) = \beta'_t v_t(n-T) + G'_t \sum_{i=1}^{M} g'_{ik}\delta(n-m_i)$$

The drive excitation signal vt(n) is supplied to an adaptive code book circuit 420. Subsequently, the response signal calculating circuit 450 calculates the response signal $x_{zt}(n)$ when an input signal is set to zero, i.e., $d_t(n)=0$ in a current sub-frame which is shorter than the length of a frame, and outputs the calculated resposne signal to the subtracter 415. Now, the response signa $X_{zt}(n)$ is expressed by the following equation (11).

$$x_{zt}(n)=d_t(n)*h_{wt}(n) \tag{11}$$

Note that $$d_t(n)=0(n\geqq 0)$$

$$d_t(n)=V_t(n)(n<0) \tag{12}$$

The subtracter 415 subtracts the response signal $x_{zt}(n)$ for 1 sub-frame from the perceptually weighted signal in accordance with the following equation (13) to determine the subtracted result $x_{wt}'(n)$, and then outputs the subtracted result $X_{wt}'(n)$ to an adaptive code book circuit 420.

$$x_{wt}'(n)=x_{wt}(n)-x_{zt}(n) \tag{13}$$

The adaptive code book circuit 420 enters therein the drive excitation signal $V_t(n)$ supplied from the response signal calculating circuit 450, the output signal $X_{wt}'(n)$ supplied from the subtracter 415 and the first impulse response signal $h_{wt}(n)$. A delay "T" corresponding to a pitch is calculated in such a manner that distortion expressed by the following equation (14) is minimized, and an index indicative of the delay is outputted to the multiplexer 500 via an output terminal 464.

$$D_T = \sum_{n=0}^{N-1} x_{wt}^2(n) - \left[ \frac{\left[ \sum_{n=0}^{N-1} x'_{wt}(n) y_{wt}(n-T) \right]^2}{\sum_{n=0}^{N-1} y_{wt}^2(n-T)} \right] \tag{14}$$

Here, the following equation is satisfied.

$$y_{wt}(n-T)=v_t(n-T)*h_{wt}(n) \tag{15}$$

Then, a gain "β" is calculated in accordance with the below-mentioned equation (16).

$$\beta = \frac{\sum_{n=0}^{N-1} x'_{wt}(n) y_{wt}(n-T)}{\sum_{n=0}^{N-1} y_{wt}^2(n-T)} \tag{16}$$

In this case, in order that the extraction precision of the delays is increased for female voice and child voice, the delays are not extracted from an integer value sample but may be extracted form a decimal number value sample. As a specific method, there is described in, for example, "PITCH PREDICTORS WITH HIGH TEMPORAL RESOLUTION" by P. Kroon et al., (Proceedings ICASSP, pages 661–664, 1990: reference No. 12).

Furthermore, in the adaptive code book circuit 420, a pitch prediction is carried out in accordance with the following equation (17), and then a prediction remaining signal $e_{wt}(n)$ is outputted to an excitation signal calculating circuit 430.

$$e_{wt}(n)=x_{wt}'(n)-\beta v_t(n-T)*h_{wt}(n) \tag{17}$$

In the excitation signal calculating circuit 430, positions and amplitudes of the prediction remaining signal $e_{wt}(n)$ are searched with respect to the allocated number of pulses k(t) inputted from the allocating circuit 330 via the input terminal 404 using the first impulse response $h_{wt}(n)$. In calculation of the positions of pulses, a calculation amount required for the search can be reduced by, for instance, limiting the positions where the pulses are set for search of the input signal. As this calculation method, there has been proposed, for example, the ACEP (Algebraic Code Excited Linear Prediction) system. This ACEP system is described in, for example, "16 KBPS WIDEBAND SPEECH CODING TECHNIQUE BASED ON ALGEBRAIC CELP" by C. Laflamme et al., (Proceedings ICASSP, pages 13–16, 1991: reference No. 13). In accordance with this ACEP system, the excitation signal is expressed as a plurality of pulses, and the positions of the respective pulses are limited such that the excitation signal is expressed and transferred by the predetermined number of bits. Also, since an amplitude of each of the pulses is defined by a value +1.0 or −1.0 and a polarity, the calculation amount required to search the position can be greatly reduced.

As another method, the amplitudes of K(t) pulses are collectively vector-quantized. Thus, in this method, the performance may be improved but a slightly more calculation amount may be required, as compared to the above-mentioned CELP system in which the polarity expression is used.

Alternatively, a code book used to quantize the amplitudes of the plurality of pulses may be provided. A learning method of this code book is previously performed by using a large amount of signals and the learning results are stored in the code book as code vectors. An example of the learning method of the code book is described in, for example, "An algorithm for Vector Quantizer Design" by Linde et al., (IEEE Transactions on Communications, pages 84–94, January, 1980: reference No. 14).

The information on the amplitudes and positions of the plurality of pulses are outputted to the gain quantizing circuit 440. Also, indexes of the amplitudes and positions of the plurality of pulses are outputted to the multiplexer 500 via output terminals 462 and 463.

The gain quantizing circuit 440 is supplied with the prediction remaining signal $e_{wt}(n)$ from the adaptive code book circuit 420, the first impulse response $h_{wt}(n)$ from the dividing circuit 340, information of the amplitude and positions, and the subtracted signal $x_{wt}(n)$ from the subtracter 415. The gain quantizing circuit 440 reads gain code vectors from a gain code book 445, and selects a proper gain code vector from these read gain code vectors such that the following equation (18) is minimized with respect to the selected amplitudes and positions. Here, the following example will now be explained. That is, both the gain of the adaptive code book and the gain of the excitation signal expressed by the pulses are vector-quantized at the same time.

$$D_k = \sum_{n=0}^{N-1} \left[ x_{wt}(n) - \beta'_t v(n-T) * h_{wt}(n) - G'_t \sum_{i=1}^{M} g'_{ik} h_{wt}(n-m_i) \right]^2 \quad (18)$$

where the symbols $\beta_k'$ and $G_k'$ represent the k-th code vectors in a two-dimensional gain code book stored in the gain code book 445. Indexes representative of the selected gain code vectors are outputted to the multiplexer 500 via an output terminal 461. It should be noted that the gain code book 445 is previously learned in accordance with the above-described reference No. 14.

Figure 3:
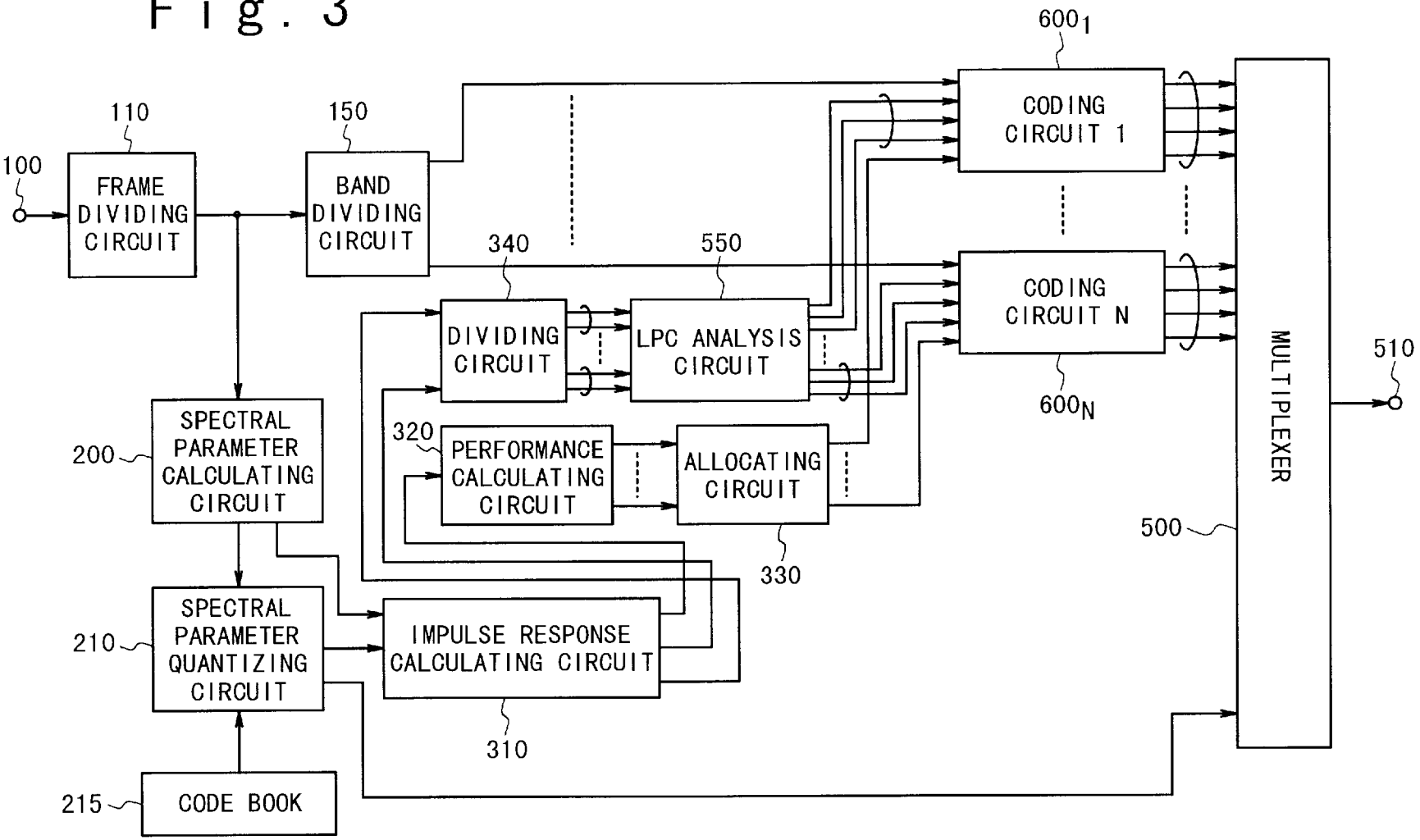
FIG. 3 is a block diagram illustrating a modification of the signal coding apparatus according to the first embodiment of the present invention.

FIG. 3 is a schematic block diagram for illustrating the structure of a modification of the signal coding apparatus according to the first embodiment of the present invention. Referring now to FIG. 3, an LPC analyzing circuit 550 inputs therein the first impulse response as $h_{wt}(n)$ and the second impulse response as $w_t(n)$ for the band "t" from the dividing circuit 340. The LPC analyzing circuit 550 calculates self-correlation function values for predetermined delay orders "P" with respect to each of these first and second impulse responses. As an example, the following equation (19) indicates how to calculate self-correlation function values C(j) with respect to the first impulse response $h_{wt}(n)$.

$$C_h(j) = \sum_{n=0}^{L-1-j} h_{wt}(n) h_{wt}(n+j) \; (j = 0, \ldots, P) \quad (19)$$

where the symbol "L" indicates a length of an impulse response when the self-correlation function values are calculated. Similarly, the self-correlation function values are calculated as to the second impulse response $w_t(n)$.

Next, as to each of the self-correlation function values, the LPC analysis for the orders P is carried out to calculate linear prediction coefficients, and the resultant linear prediction coefficients and also the first impulse response $h_{wt}(n)$ are outputted to the coding circuit for the band "t". This process operation is carried out with respect to all of the bands. It is now assumed that linear prediction coefficients for the first and second impulse responses $h_{wt}(n)$ and $w_t(n)$ for the band "t" are $\alpha_{ht}(i)$ and $\alpha_{wt}(i)$ (i=1, . . . , P), respectively.

Figure 4:
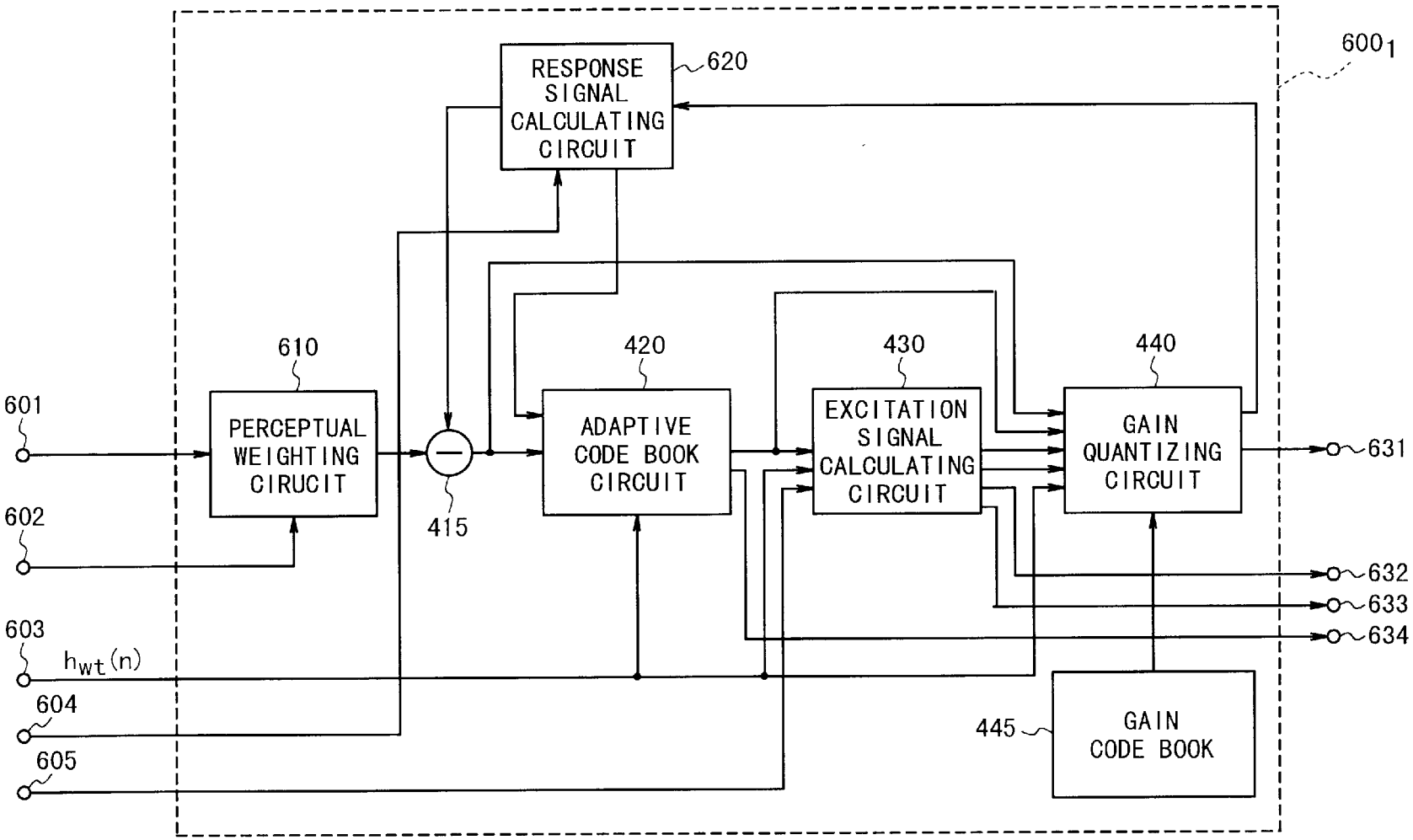
FIG. 4 is a block diagram illustrating a coding circuit of the modification of the signal coding apparatus shown in FIG. 3.

FIG. 4 is a schematic block diagram for representing the structure of the coding circuit-1 $\mathbf{600}_1$. Referring to FIG. 4, the input signals $x_t(n)$, the linear prediction coefficients $\alpha_{wt}(i)$, the first impulse response $h_{wt}(n)$, and the linear prediction coefficients $\alpha_{wt}(i)$, and the allocated number of pulses are entered from terminals 601, 602, 603, 604, and 605.

A perceptual weighting circuit 610 performs the weighting process of the input signal $x_t(n)$ in accordance with the linear prediction coefficients $\alpha_{wt}(i)$ by a filtering process represented by the following equation (20).

$$x_{wt}(n) = x_t(n) + \sum_{i=1}^{P} \alpha_{wt}(i) x_{wt}(n-i) \quad (20)$$

The response signal calculating circuit 450 receives indexes of gain and delay of an adaptive code book, indexes of amplitudes and positions of an excitation signal, an index of gain code vector from a gain quantizing circuit 440, reads out a code vector in accordance with the received indexes, and calculates a drive excitation signal $v_t(n)$ based on the following equation (21).

$$v_t(n) = \beta'_t v_t(n-T) + G'_t \sum_{i=1}^{M} g'_{ik} \delta(n-m_i) \quad (21)$$

The drive excitation signal vt(n) is supplied to an adaptive code book circuit 420. Subsequently, the response signal calculating circuit 450 calculates the response signal $s_{wt}(n)$ when an input signal is set to zero, i.e., $d_t(n)=0$ in a current sub-frame which is shorter than the length of a frame, based on the following equation (22).

$$s_{wt}(n) = v_t(n) + \sum_{i=1}^{P} \alpha_{ht}(i) s_{wt}(n-i) \quad (22)$$

Furthermore, the response signal $x_{zt}(n)$ when the input signal is set to zero, i.e., $d_t(n)=0$ is calculated for 1 sub-frame by use of saved values of a filter memory, and the calculated response signal $x_{zt}(n)$ is outputted to the subtracter 415 which is the same in the first embodiment. Now, the response signal $x_{zt}(n)$ is expressed by the following equation (23).

$$x_{zt}(n) = d_t(n) + \sum_{i=1}^{P} \alpha_{ht}(i) x_{zt}(n-i) \quad (23)$$

Note that if $n-i \leqq 0$, then:

$$y(n-i) = p(N+(n-i)) \quad (24)$$

$$x_{zt}(n-i) = s_{wt}(N+(n-i)) \quad (25)$$

Figure 5:
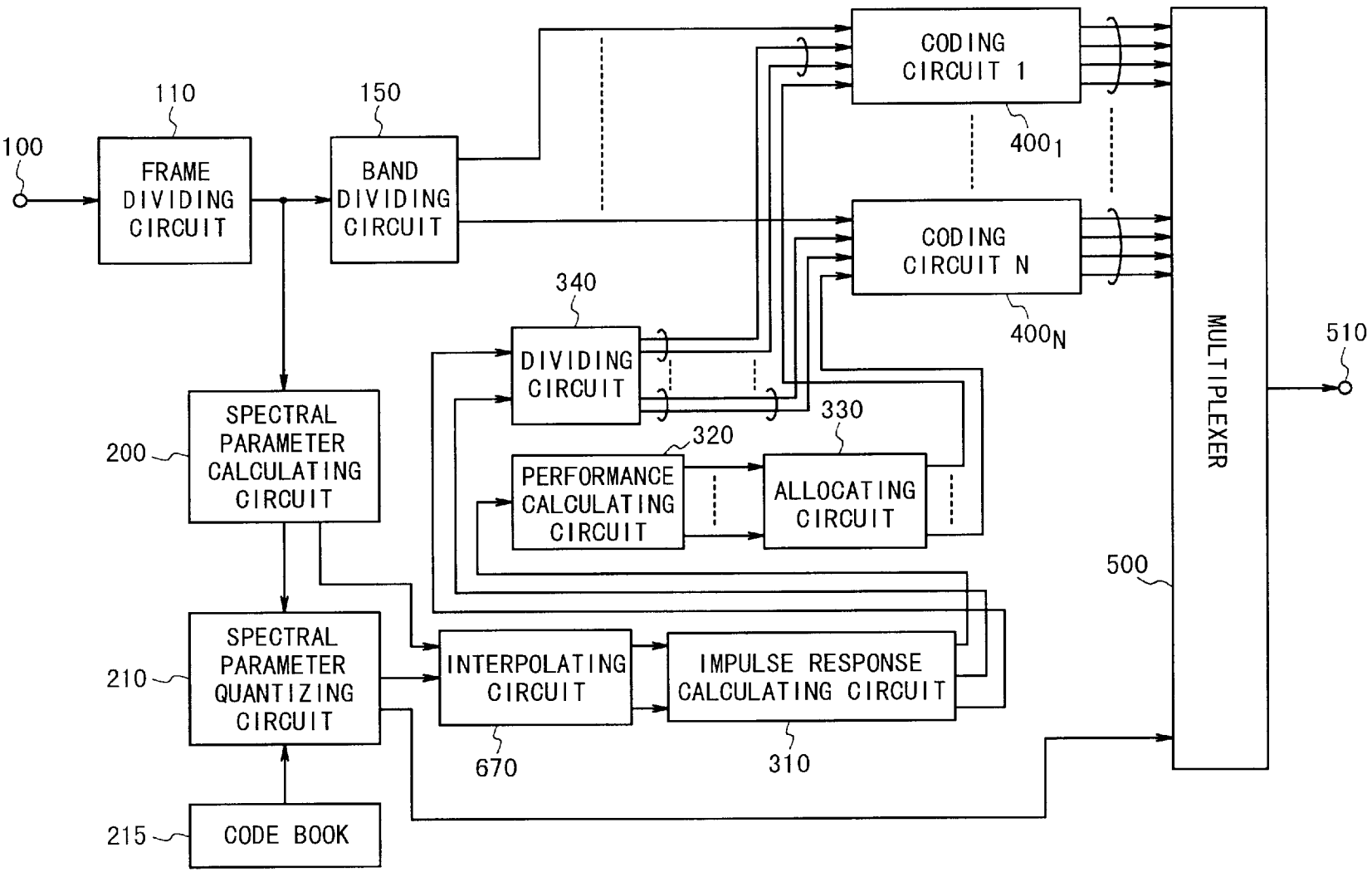
FIG. 5 is a block diagram illustrating a signal coding apparatus according to the second embodiment of the present invention.

FIG. 5 is a schematic block diagram for illustrating the structure of a signal coding apparatus according to the second embodiment of the present invention. It should be understood that the same reference numerals shown in FIG. 1 will be allocated for denoting the same, or similar circuit elements of the second embodiment, and therefore, only a different point from the first embodiment of FIG. 1 will be explained. In the second embodiment of the present invention, the spectral parameter is interpolated for every time period which is shorter than the frame length. The performance request value is determined for each of the bands based on the interpolated parameter.

Referring now to FIG. 5, an interpolating circuit 670 interpolates linear prediction coefficients, entered from the spectral parameter calculating circuit 200, for every sub-frame which is shorter than the length of a frame, and then outputs interpolated parameters to the impulse response calculating circuit 310. In order to interpolate the linear prediction coefficients, for instance, these linear prediction coefficients are once converted into an LSP parameter and an interpolation is carried out with respect to the LSP parameter, and thereafter the interpolated LSP parameter is inverse-converted into linear prediction coefficients again.

Also, the quantized LSP parameter is inputted from the spectral parameter quantizing circuit 210 to be interpolated in units of sub-frames, and then the interpolated result is inverse-converted into linear prediction coefficients. The resulting linear prediction coefficients are outputted to the impulse response calculating circuit 310. It should be noted that this interpolating circuit 670 may be added to the structure shown in FIGS. 1 to 4.

Figure 6:
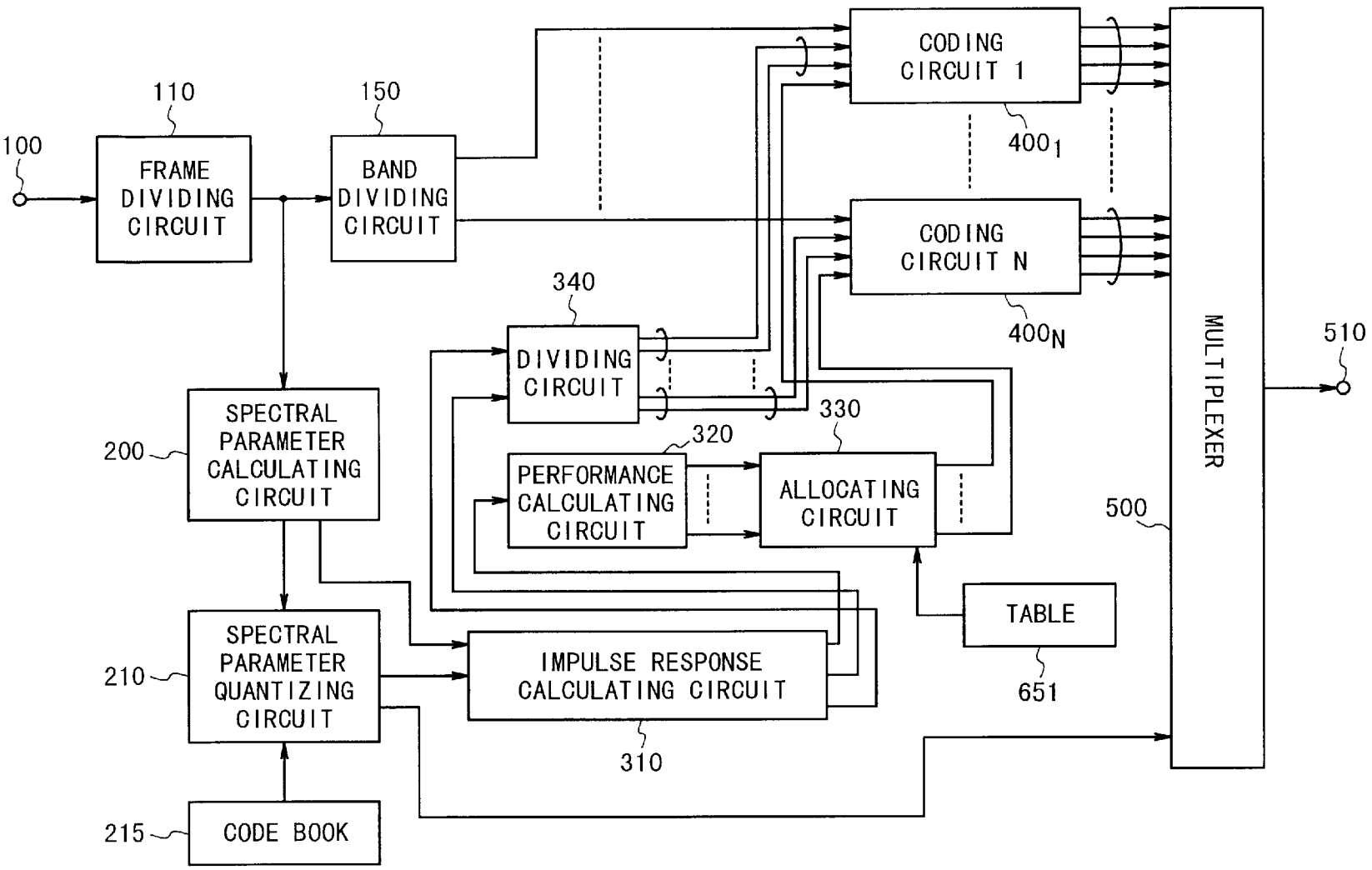
FIG. 6 is a block diagram illustrating a signal coding apparatus according to the third embodiment of the present invention.

FIG. 6 is a schematic block diagram for illustrating the structure of the signal coding apparatus according to the third embodiment of the present invention. It should be understood that the same reference numerals shown in FIG. 1 will be used for denoting the same circuit elements of the third embodiment, and therefore, only a different point from the first embodiment of FIG. 1 will be explained. In the third embodiment of the present invention, a table which indicates a relation of the number of pulses and the performance request value in the first embodiment is previously provided for each of the bands and the number of pulses can be adaptively allocated to each of the bands using the performance request value and the table.

That is, referring now to FIG. 6, an allocating circuit 650 previously forms a table 651 for representing relation of the number of pulses and S/N performance for each of the bands. For instance, an average S/N is previously measured for every band for each of a great amount of signals while the number of pulses is changed. Then, this average S/N is stored into the table 651 for every band. When an SMR(t) for the band "t" as the performance request value is inputted from the performance calculating circuit 320, the allocating circuit 650 refers to the table to search the table 651 for the SMR(t) and allocates the number of pulses to the coding circuits. A more specific process operation is given as follows.

That is, first, the number of pulses for each of the bands is set to be 1, and an SNR(t) is read from the table 651 for the band "t". Then, the MNR(t) is calculated by using the following equation (26).

$$MNR(t)=SNR(t)-SMR(t)[\text{dB}] \tag{26}$$

A total of the numbers of bits for all of the bands is calculated, and then the allowable number of bits is calculated. In the band in which MNR(t) has a minimum, the number of pulses is incremented by "1" to correct or modify the value of SNR(t). Then, the allowable number of bits is calculated again. These calculations are repeated. These process operations are repeated unless the allowable number of bits becomes negative.

It should be noted that the allocating circuit 650 and the table 651 may be combined with the structure shown in FIGS. 1 to 5.

Figure 7:
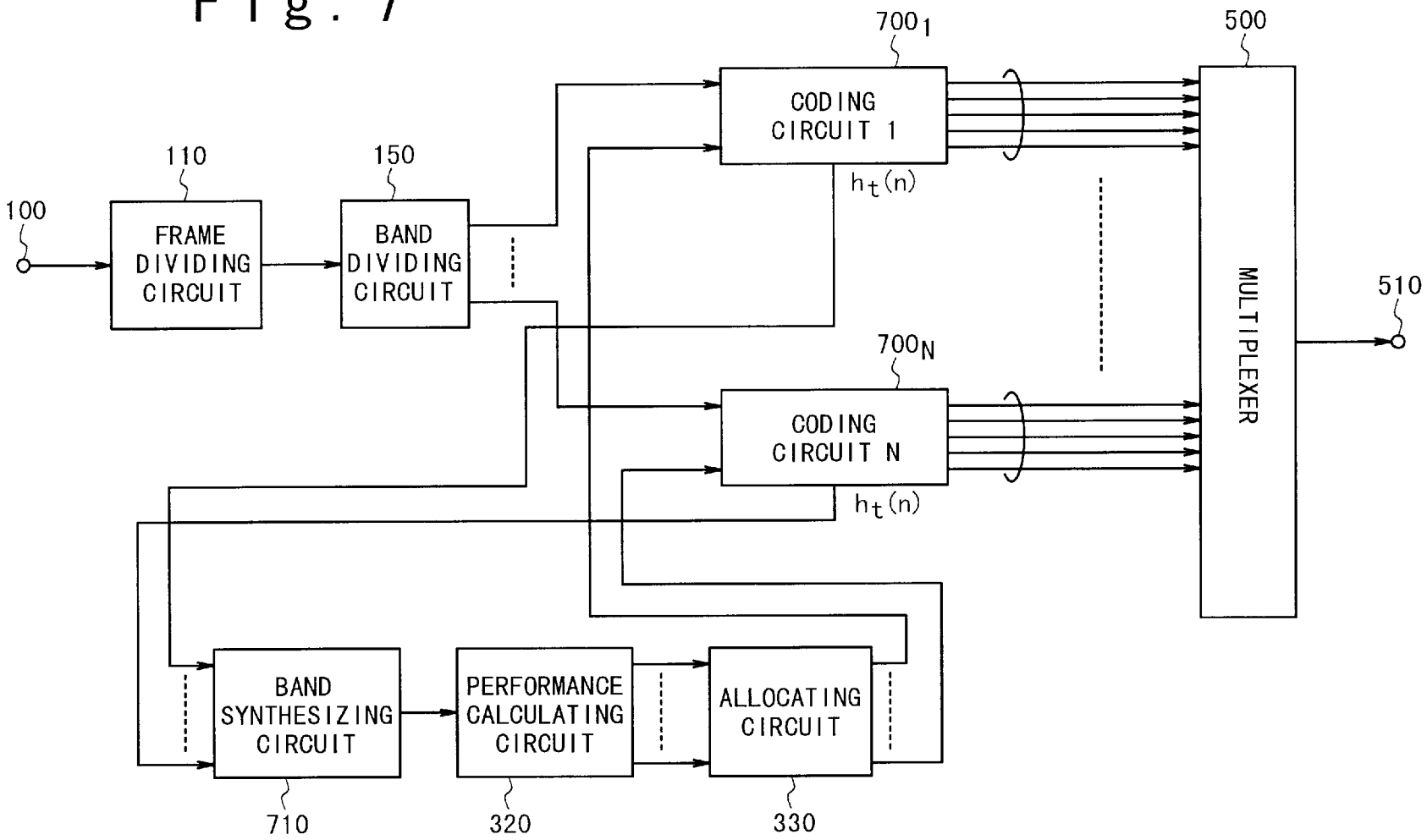
FIG. 7 is a block diagram illustrating a signal coding apparatus according to the fourth embodiment of the present invention.

FIG. 7 is a schematic block diagram for illustrating the structure of the signal coding apparatus according to the fourth embodiment of the present invention. It should be understood that the same reference numerals shown in FIG. 1 will be employed as those for denoting the same, or similar circuit elements of the second embodiment, and therefore, only a different point from the first embodiment of FIG. 1 will be explained. In the fourth embodiment of the present invention, an input signal is divided into a plurality of bands for every predetermined frame, and a spectral parameter (for example, LPC coefficients) representative of a spectral envelop is calculated from the band divided signal. A performance request value is determined for each of the bands based on the spectral parameter, and the number of pulses used for representing the excitation signal is adaptively allocated to each of the bands in accordance with the performance request value.

That is, referring now to FIG. 7, each of coding circuits $\mathbf{700}_1$ to $\mathbf{700}_N$ inputs therein a corresponding one of signals divided in units of bands by the band dividing circuit 150. It is now assumed that a signal in a band "t" is $x_t(n)$. Since the coding circuits $\mathbf{700}_1$ to $\mathbf{700}_N$ are the same operation, only the coding circuit $\mathbf{700}_1$ will now be described with reference to FIG. 8.

Figure 8:
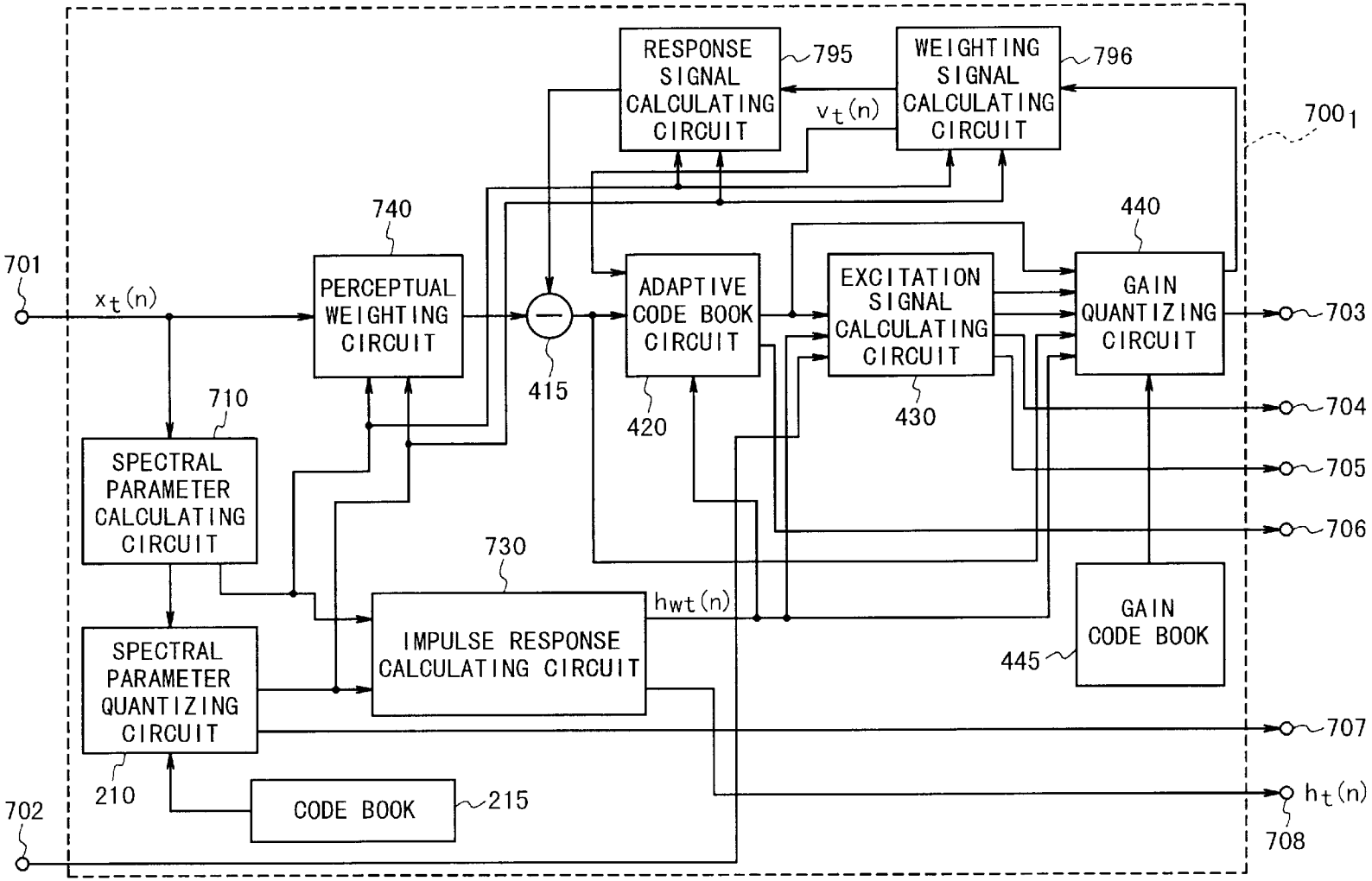
FIG. 8 is a block diagram illustrating a coding circuit $\mathbf{700}_1$ of the signal coding apparatus according to the fourth embodiment of the present invention.

Referring to FIG. 8, the signal $x_t(n)$ and the allocated number of pulses K(b) are entered from terminals 701 and 702, respectively. A spectral parameter calculating circuit 710 calculates linear prediction coefficients as a spectral parameter only by predetermined orders "P" with respect to the signal $x_t(n)$. The specific operation of this spectral parameter calculating circuit 710 is identical to that of the spectral parameter calculating circuit 200 except for the input signal.

The impulse response calculating circuit 730 enters therein the linear prediction coefficients $\alpha_t(i)$ from the spectral parameter calculating circuit 710 and the quantized linear prediction coefficients $\alpha_t'(i)$ from the spectral parameter quantizing circuit 210, and then calculates two kinds of impulse response in accordance with the following equations (27) and (28).

The first impulse response $h_{wt}(n)$ is equivalent to an impulse response of a filter having a transfer characteristic of the following equation (27).

$$H_w(z)=\left[\frac{1-\sum_{i=1}^{P}\alpha_t(i)iz^{-i}}{1-\sum_{i=1}^{P}\alpha_t(i)\gamma^i z^{-i}}\times\frac{1}{1-\sum_{i=1}^{P}\alpha'_t(i)\gamma^i z^{-i}}\right] \tag{27}$$

A second impulse response is equivalent to an impulse response $h_t(n)$ of a synthesized filter having a transfer characteristic of the following equation (28).

$$H(z)=\frac{1}{1-\sum_{i=1}^{P}\alpha't(i)iz^{-i}} \tag{28}$$

The first impulse response is outputted to the adaptive code book circuit 420, the excitation signal calculating circuit 430, and the gain quantizing circuit 440. The second impulse response is outputted via an output terminal 708.

A perceptual weighting circuit 740 enters therein the input signal $x_t(n)$ and the two kinds of linear prediction coefficients $\alpha_t(i)$ and $\alpha_t'(i)$, and performs a filtering process using a filter having a transfer characteristic $H_w(z)$ expressed in the following equation (29), and then calculates a perceptual weighting signal $x_{wt}(n)$ which is outputted to the subtracter 415.

$$H_w(z)=\left[\frac{1-\sum_{i=1}^{P}\alpha_t(i)z^{-i}}{1-\sum_{i=1}^{P}\alpha_t(i)\gamma^i z^{-i}}\times\frac{1}{1-\sum_{i=1}^{P}\alpha'_t(i)\gamma^i z^{-i}}\right] \tag{29}$$

where the symbol "γ" indicates weighting coefficients for controlling a perceptual weighting amount. This filtering process may be expressed on z-transform by the following equation (30).

$$X_{wt}(z)=X_t(z)H_w(z) \tag{30}$$

A weighting signal calculating circuit 796 inputs therein indexes of an adaptive code book, indexes of amplitudes and positions of pulses, and an index of a gain code vector from a gain quantizing circuit 440, and reads a code vector corresponding to the indexes. The weighting signal calculating circuit 796 first calculates a drive excitation signal $V_t(n)$ based on the following equation (31).

$$v_t(n) = \beta'_1 v_t(n-T) + G'_1 \sum_{i=1}^{M} g'_{ik}\delta(n-m_i) \tag{31}$$

Then, the drive excitation signal $V_t(n)$ is outputted to the adaptive code book circuit 420.

Next, a response signal $sw_t(n)$ is calculated based on the following equation (32) by using an output parameter of the spectral parameter calculating circuit 710 and an output parameter of the spectral parameter quantizing circuit 210, then is outputted to a response signal calculating circuit 795.

$$s_{wt}(n) = v_t(n) - \sum_{i=1}^{P} \alpha_t(i) v_t(n-i) + \sum_{i=1}^{P} \alpha_t(i)\gamma^i p(n-i) + \sum_{i=1}^{P} \alpha'_t(i)\gamma^i s_{wt}(n-i) \tag{32}$$

The response signal calculating circuit 795 inputs therein the linear prediction coefficients $\alpha_t(i)$ from the spectral parameter calculating circuit 710, and the quantized and then recovered linear prediction coefficients $\alpha_t'(i)$ from the spectral parameter quantizing circuit 210, and calculates a response signal when an input signal is set to zero, i.e., $d_t(n)=0$ for 1 sub-frame by using saved values of a filter memory. The calculated response signal is outputted to the subtracter 415. Now, the response signal $x_{zt}(n)$ is expressed by the following equation (33).

$$x_{zt}(n) = d_t(n) - \sum_{i=1}^{P} \alpha_t(i) d_t(n-i) + \sum_{i=1}^{P} \alpha_t(i)\gamma^i y_t(n-i) + \sum_{i=1}^{P} \alpha'_t(i)\gamma^i x_{zt}(n-i) \tag{33}$$

Note that if $n-i \leqq 0$, then:

$$y_t(n-i)=p(N+(n-i)) \tag{34}$$

$$x_{zt}(n-i)=s_{wt}(N+(n-i)) \tag{35}$$

where the symbol "N" indicates the length of a sub-frame, and the symbols $sw_t(n)$ and $p(n)$ represent output signals from the weighting signal calculating circuit.

Referring again to FIG. 7, a band synthesizing circuit 710 enters therein the impulse responses $h_t(n)$ outputted from the coding circuits $\mathbf{700}_1$ to $\mathbf{700}_N$ for the respective bands. The impulse responses are filtered by a band synthesizing filter to calculate an impulse response h(n) for all the bands only with respect to preselected points, and the calculated impulse response is outputted to the performance calculating circuit 320. In this case, the well known QMF synthesizing filter may be used as this band synthesizing filter. The detailed description can be referred to the above-described reference No. 11.

Figure 9:
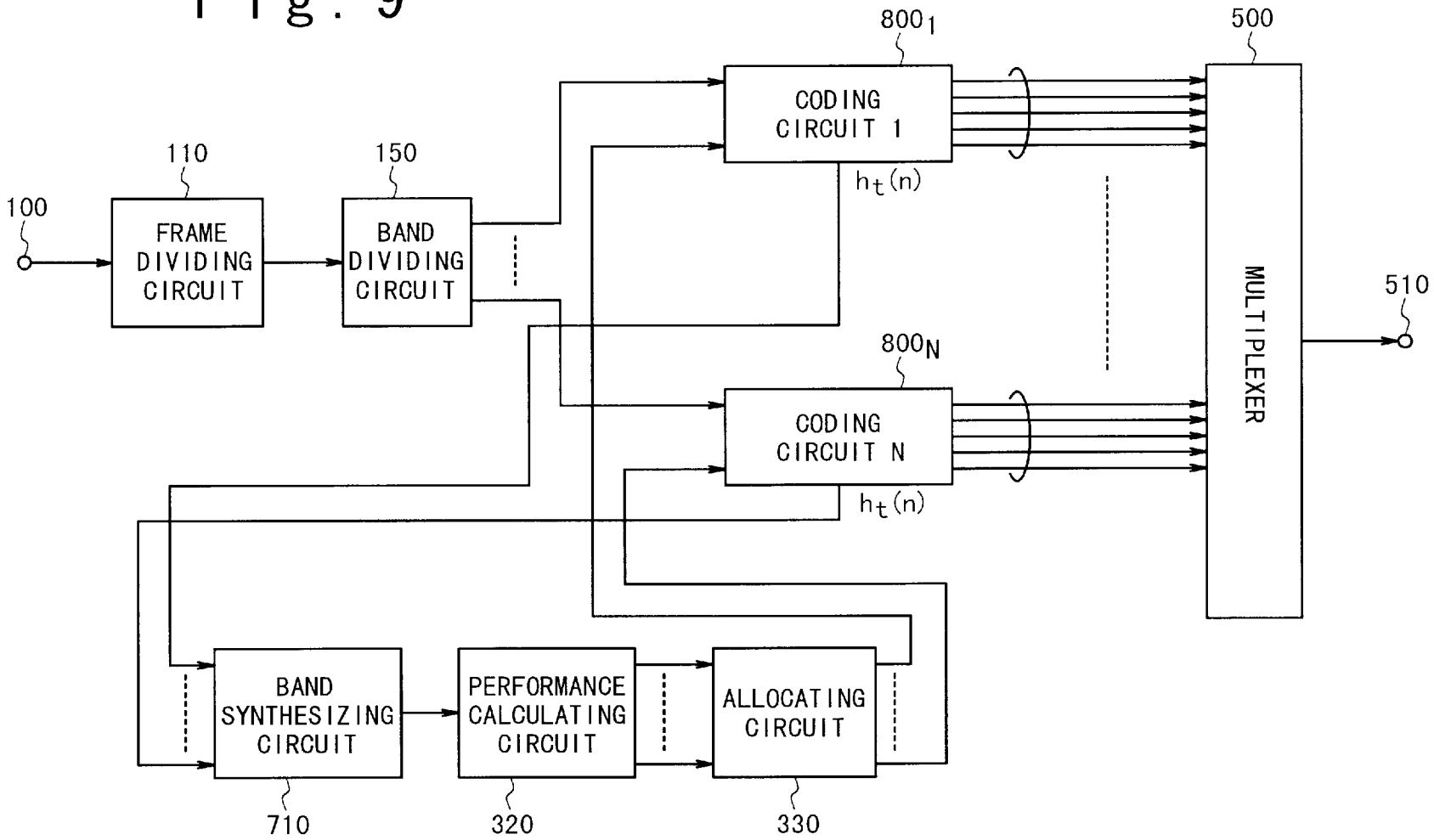
FIG. 9 is a block diagram illustrating a signal coding apparatus according to the fifth embodiment of the present invention.
Figure 10:
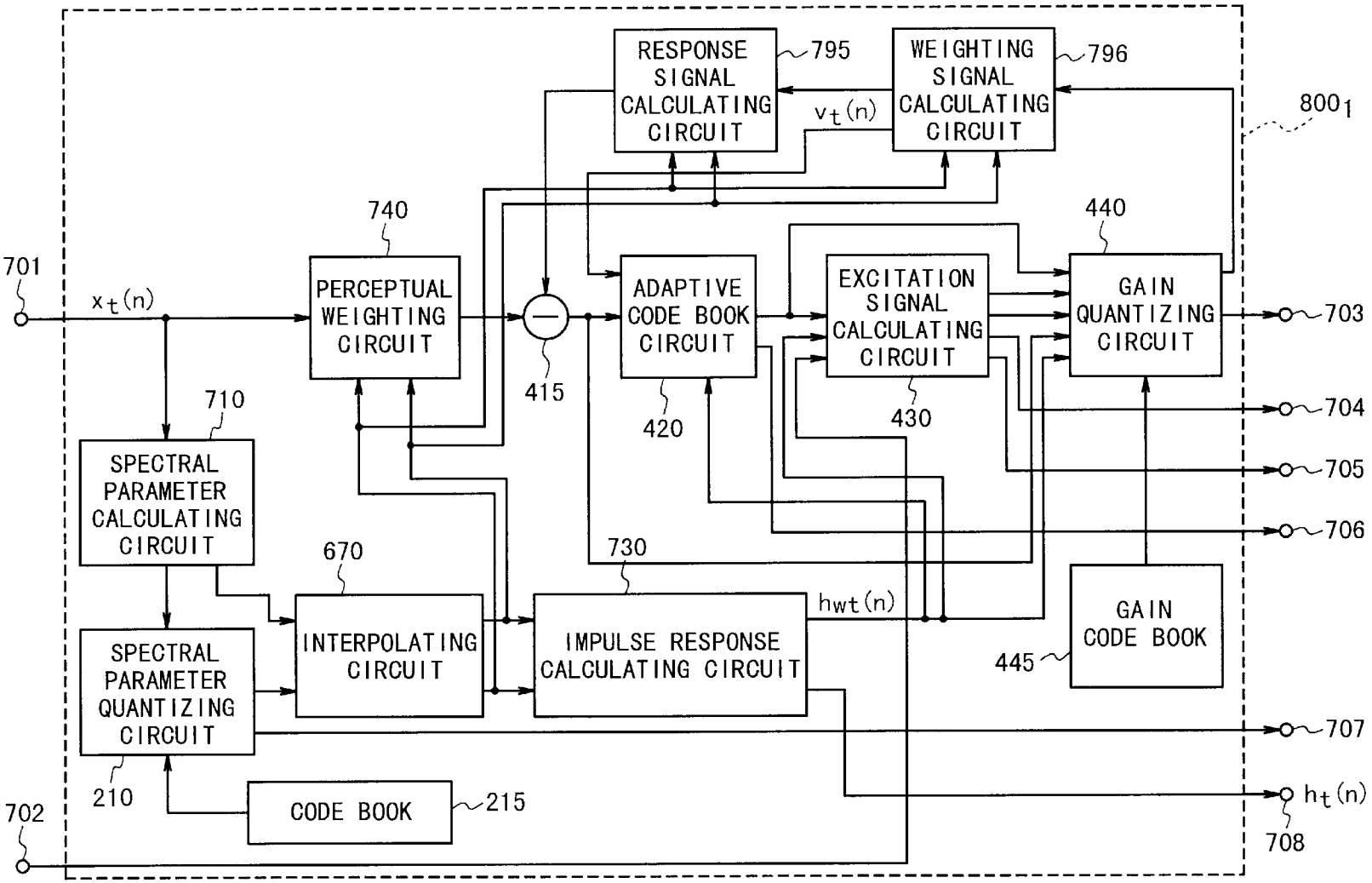
FIG. 10 is a block diagram illustrating a coding circuit $\mathbf{800}_1$ of the signal coding apparatus according to the fifth embodiment of the present invention.

FIG. 9 is a schematic block diagram for illustrating the structure of the signal coding apparatus according to the fifth embodiment of the present invention. It should be understood that the same reference numerals shown in FIG. 7 will be employed as those for denoting the same, or similar circuit elements of the fifth embodiment, and therefore, only a different point from the fourth embodiment of FIG. 7 will be described. That is, since operations of coding circuits $\mathbf{800}_1$ to $\mathbf{800}_N$ used in this fifth embodiment are different from those of the coding circuits $\mathbf{700}_1$ to $\mathbf{700}_N$, the structure of the coding circuit $\mathbf{800}_1$, is indicated in FIG. 10. It should be understood that the same reference numerals shown in FIG. 8 will be used as those for denoting the same, or similar circuit elements of the fifth embodiment shown in FIG. 10, and therefore, only a different point from the fourth embodiment of FIG. 8 will be explained. In the fifth embodiment of the present invention, the spectral parameter is interpolated for every sub-frame as a time period which is shorter than the frame length in the fourth embodiment, and the performance request value is determined for each of the bands based on the interpolated parameter.

Referring now to FIG. 10, an interpolating circuit 670 is a different point from the coding circuit shown in FIG. 8. The interpolating circuit 670 performs the same interpolation operation as that of the interpolating circuit 670 indicated in FIG. 5. In other words, the interpolating circuit 670 interpolates linear prediction coefficients entered from s spectral parameter calculating circuit 710 every sub-frame which is shorter than the length of a frame, and then outputs an interpolated parameter to an impulse response calculating circuit 730. In order to interpolate the linear prediction coefficients, for instance, these linear prediction coefficients are once converted into an LSP parameter and an interpolation is carried out with respect to the LSP parameter, and thereafter the interpolated LSP parameter is inverse-converted into the linear prediction coefficients. Also, the quantized LSP parameter is inputted from the spectral parameter quantizing circuit 710 to be interpolated in units of sub-frames, and then the interpolated result is inverse-converted into the linear prediction coefficients. The resulting linear prediction coefficients are outputted to the impulse response calculating circuit 730.

Figure 11:
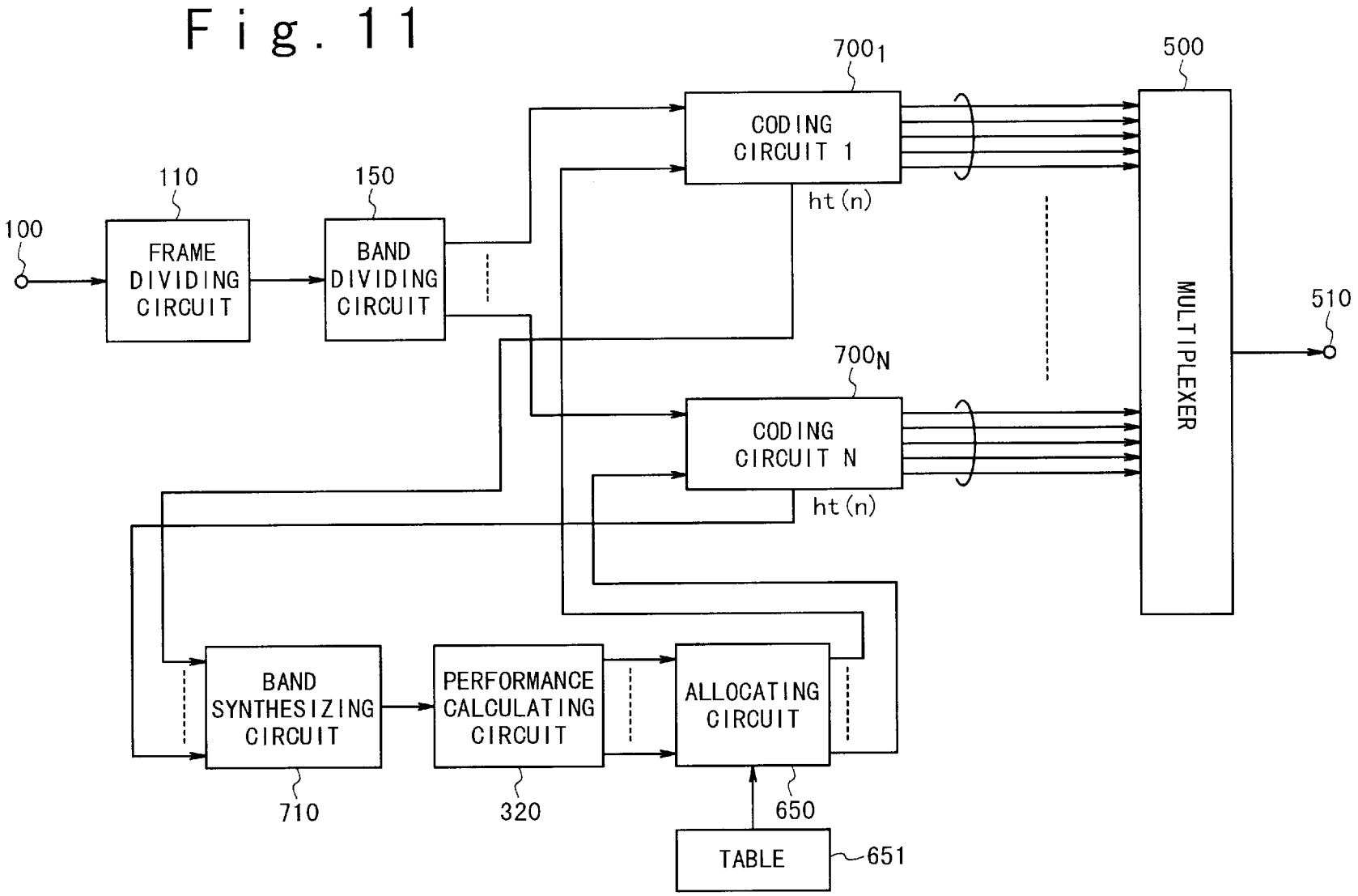
FIG. 11 is a block diagram illustrating a signal coding apparatus according to the sixth embodiment of the present invention.

FIG. 11 is a schematic block diagram for illustrating the structure of the signal coding apparatus according to the sixth embodiment of the present invention. A difference point between FIG. 11 and FIG. 9 is an allocating circuit 650. The allocating circuit 650 performs the same operation as that of the allocating circuit shown in FIG. 6, and allocates the number of pulses for every band by using a table 651.

Figure 12:
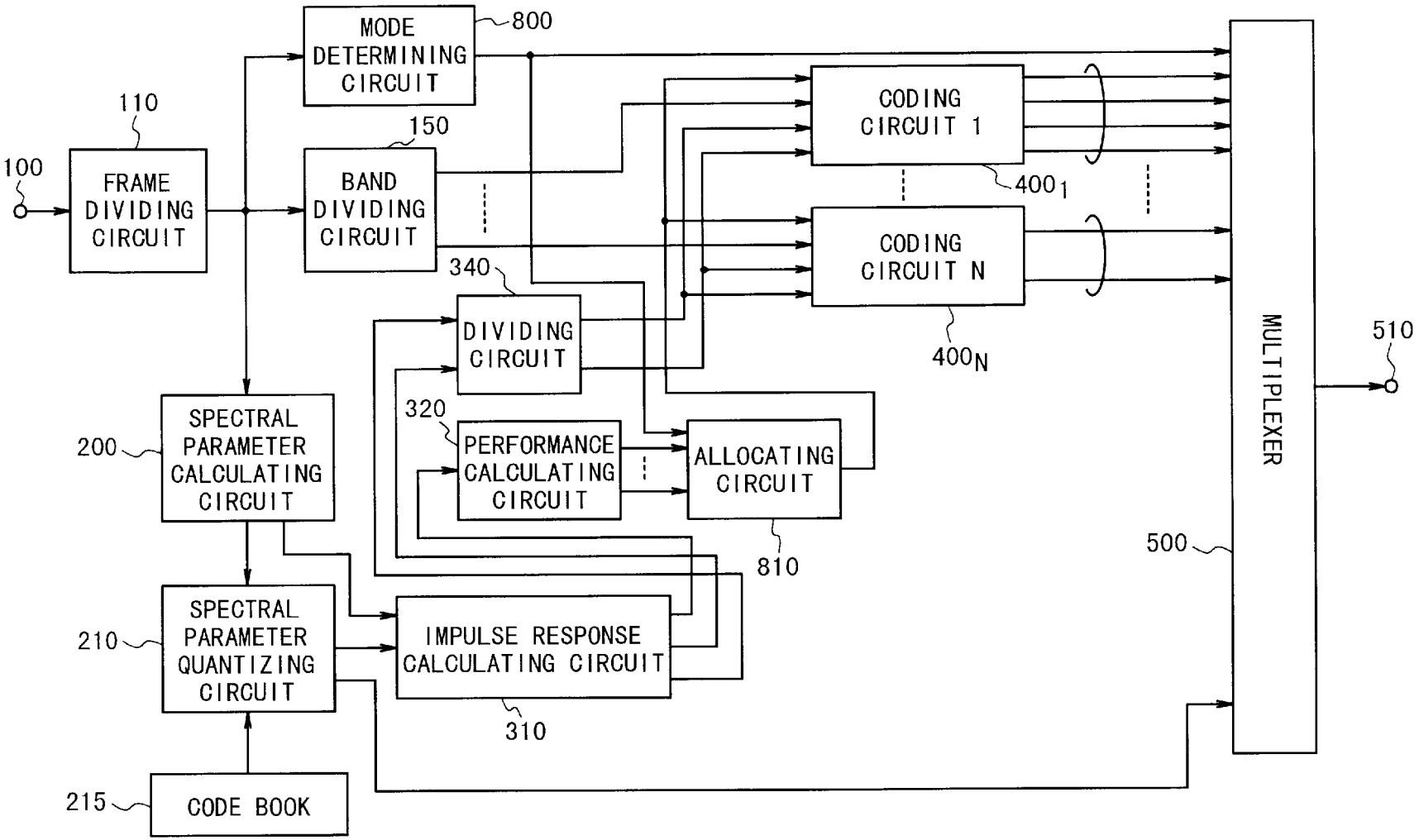
FIG. 12 is a block diagram illustrating a signal coding apparatus according to the seventh embodiment of the present invention.

FIG. 12 is a schematic block diagram for illustrating the structure of the signal coding apparatus according to the seventh embodiment of the present invention. A difference point between FIG. 12 and FIG. 1 is in a mode determining circuit 800 and an allocating circuit 810. In the seventh embodiment of the present invention, an input signal is divided into a plurality of bands for every predetermined frame, and a spectral parameter (for example, LPC coefficients) representative of a spectral envelop is calculated from the input signal. Also, a feature amount is extracted from the input signal to determine one of modes. A performance request value is determined for each of the bands based on the spectral parameter, and the number of pulses used for representing the excitation signal is adaptively allocated to each of the bands in accordance with the performance request value.

Referring now to FIG. 12, the mode determining circuit 800 receives a frame signal obtained by dividing an input signal in units of the framesthe frame dividing circuit 110, and outputs mode information to the allocating circuit 810 and the multiplexer 500. In this case, a feature amount of the current frame is used so as to determine the mode. As the feature amount, for example, a pitch prediction gain averaged over the current frame is used. The pitch prediction gain is calculated by using, for instance, the following equation (36).

$$G = 10 \log_{10} \left[ \frac{1}{L} \sum_{i=1}^{L} \left( \frac{P_i}{E_i} \right) \right] \tag{36}$$

where the symbol "L" indicates the number of sub-frames contained in the frame. It should be noted that "L" may be set to be 1. The symbols $P_i$ and $E_i$ denote speech power and pitch prediction error power in an i-th sub-frame, respectively, and are given by the following equations (37) and (38).

$$P_i = \sum_{n=0}^{N-1} x_i^2(n) \tag{37}$$

$$E_i = P_i - \frac{\left[ \sum_{n=0}^{N-1} x_i(n) x_i(n - T_i) \right]^2}{\sum_{n=0}^{N-1} x_i^2(n - T_i)} \tag{38}$$

where the symbol "$T_i$" indicates an optimum delay capable of maximizing the prediction gain. The frame-averaged pitch prediction gain G is compared with either one threshold value or a plurality of threshold values, which are predetermined, and one of a plurality of modes is selected based on the comparing result. For instance, four modes may be employed.

The allocating circuit 810 adaptively allocates the number of pulses for every band in accordance with SMR(t) and the mode determining information. As a simple allocation example, assuming now that the coding S/N (signal-to-noise ratio) per 1 pulse is $A_j$ [dB] (j=1, . . . , U: U being the number of modes) in accordance with the mode, SMR(t) is divided by $A_j$, so that the necessary number of pulses may be calculated for each band. In this manner, the allocated numbers K(t) of pulse are calculated for the respective bands, and then are outputted to the coding circuits $\mathbf{400}_1$ to $\mathbf{400}_N$ in the above-described manner. It should be noted that when the allocation of the number of pulses is carried out, the number of transfer bits B is calculated by summing the number of pulses over all the band, and the numbers of pulses are controlled so as to satisfy B=R. In this case, the symbol "R" indicates a predetermined transfer rate. Also, the following equation (39) is satisfied.

$$B = \sum_{t=1}^{N} b(t) \tag{39}$$

where the symbol "b(t)" indicates the number of transfer bits for the band "t" calculated from the allocated number of pulses for the band "t" and other transfer bit information, and the symbol "N" represents the number of bands.

It should also be noted that also in the coding circuits $\mathbf{400}_1$ to $\mathbf{400}_N$, the read operation from the adaptive code book and the gain code book may be switched by using the mode information. Further, the code book 215 may be switched by using the mode determining information even in the spectral parameter quantizing circuit 210.

Figure 13:
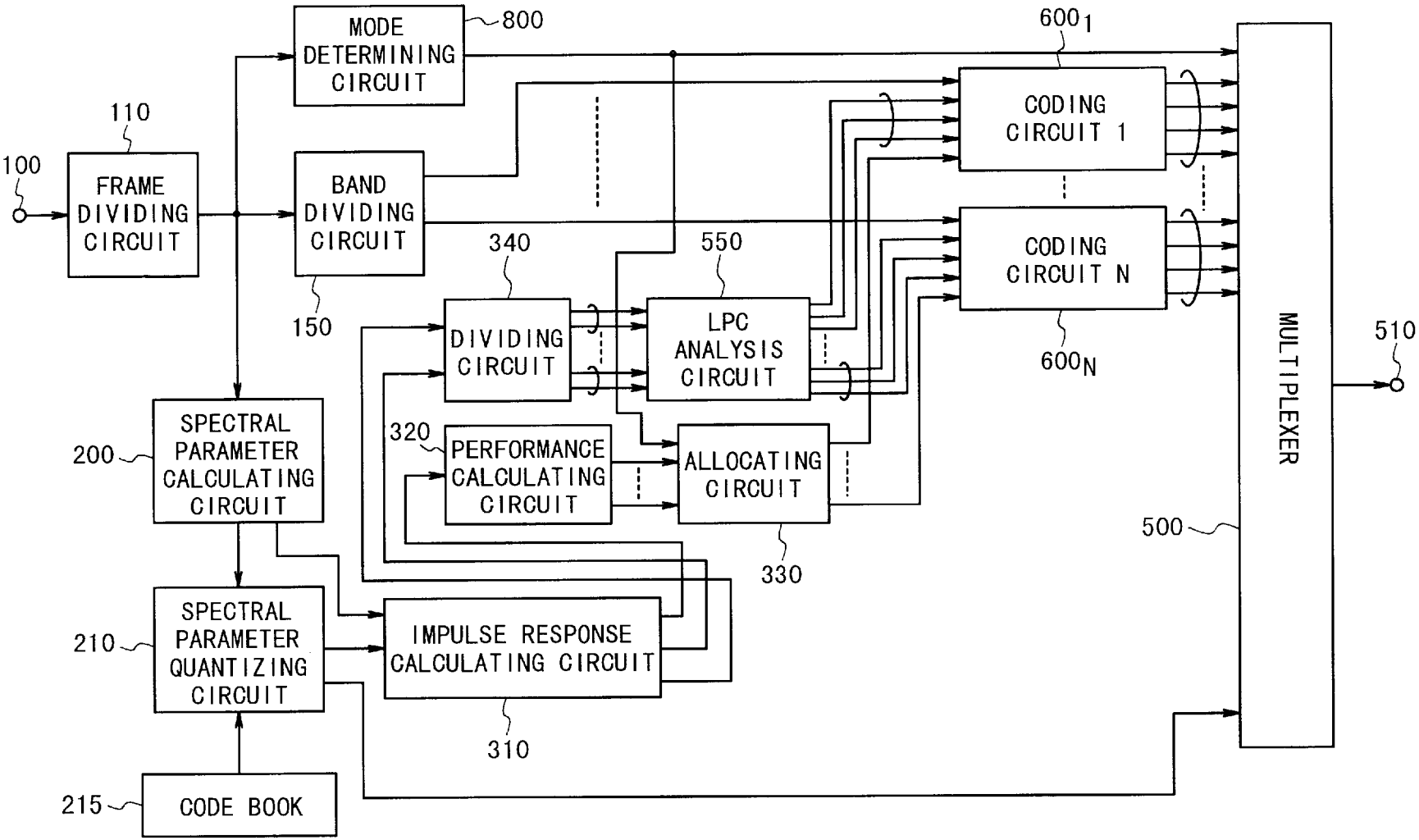
FIG. 13 is a block diagram illustrating a modification of the signal coding apparatus according to the seventh embodiment of the present invention.

FIG. 13 is a schematic block diagram for illustrating a modification of the signal coding apparatus according to the seventh embodiment of the present invention. Referring now to FIG. 13, according to this embodiment, an LPC analyzing circuit 550 is added to the structure shown in FIG. 12, and a self-correlation function value is determined for every band by using the impulse response band-divided by the dividing circuit 340, and then the linear prediction coefficients are calculated by way of the LPC analysis. Furthermore, the coding circuits $\mathbf{600}_1$ to $\mathbf{600}_N$ enter therein the linear prediction coefficients for every band so as to code these linear prediction coefficients. The structures of the LPC analyzing circuits 550 and the coding circuits $\mathbf{600}_1$ to $\mathbf{600}_N$ are identical to those of FIG. 3.

Figure 14:
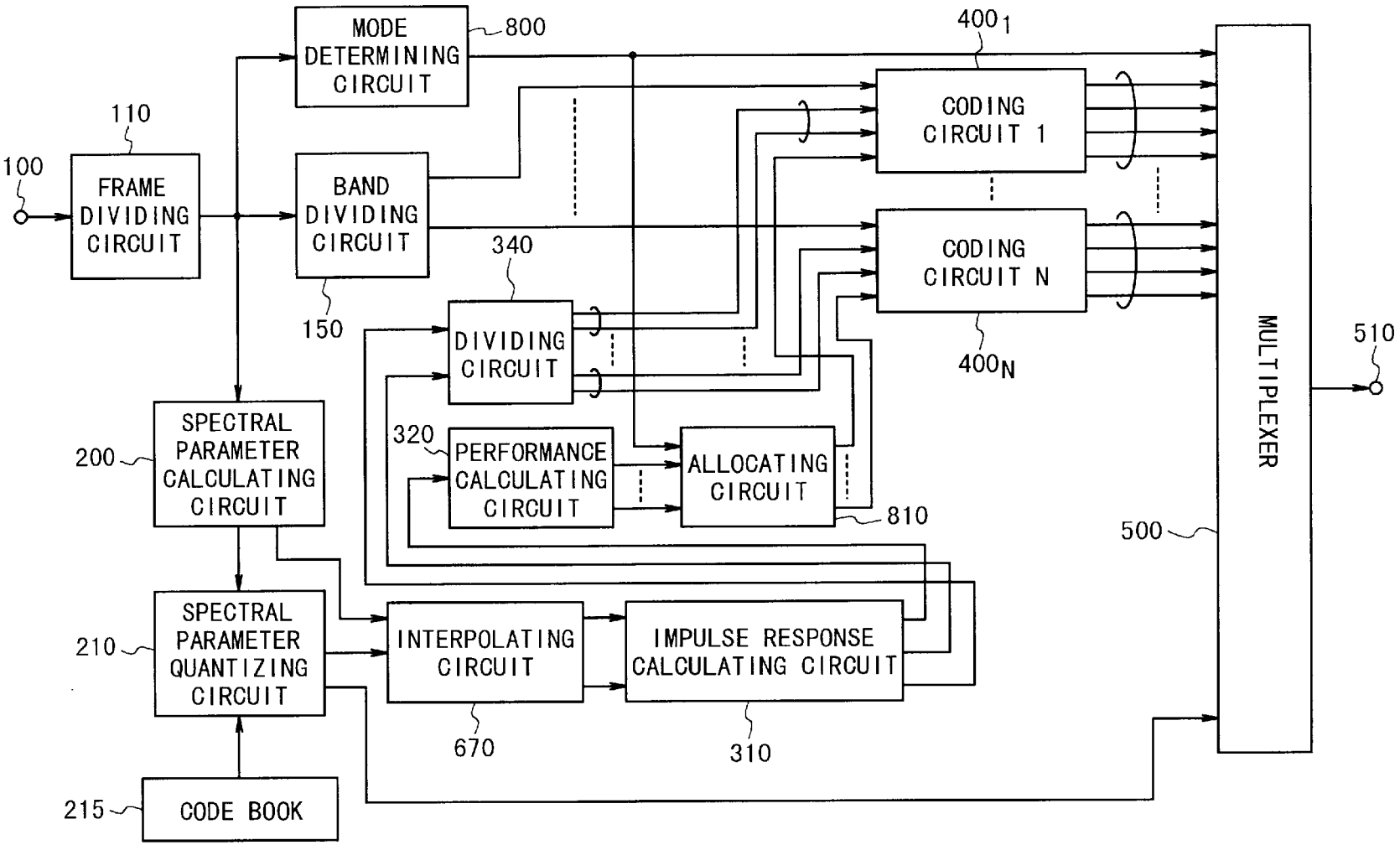
FIG. 14 is a block diagram illustrating a signal coding apparatus according to the eighth embodiment of the present invention.

FIG. 14 is a schematic block diagram for representing the structure of the signal coding apparatus according to the eighth embodiment of the present invention. In the structure of FIG. 12, an interpolating circuit 670 is additionally provided. This interpolating circuit 670 has the same circuit structure as that of FIG. 5 and operates in the same manner as that of FIG. 5.

Figure 15:
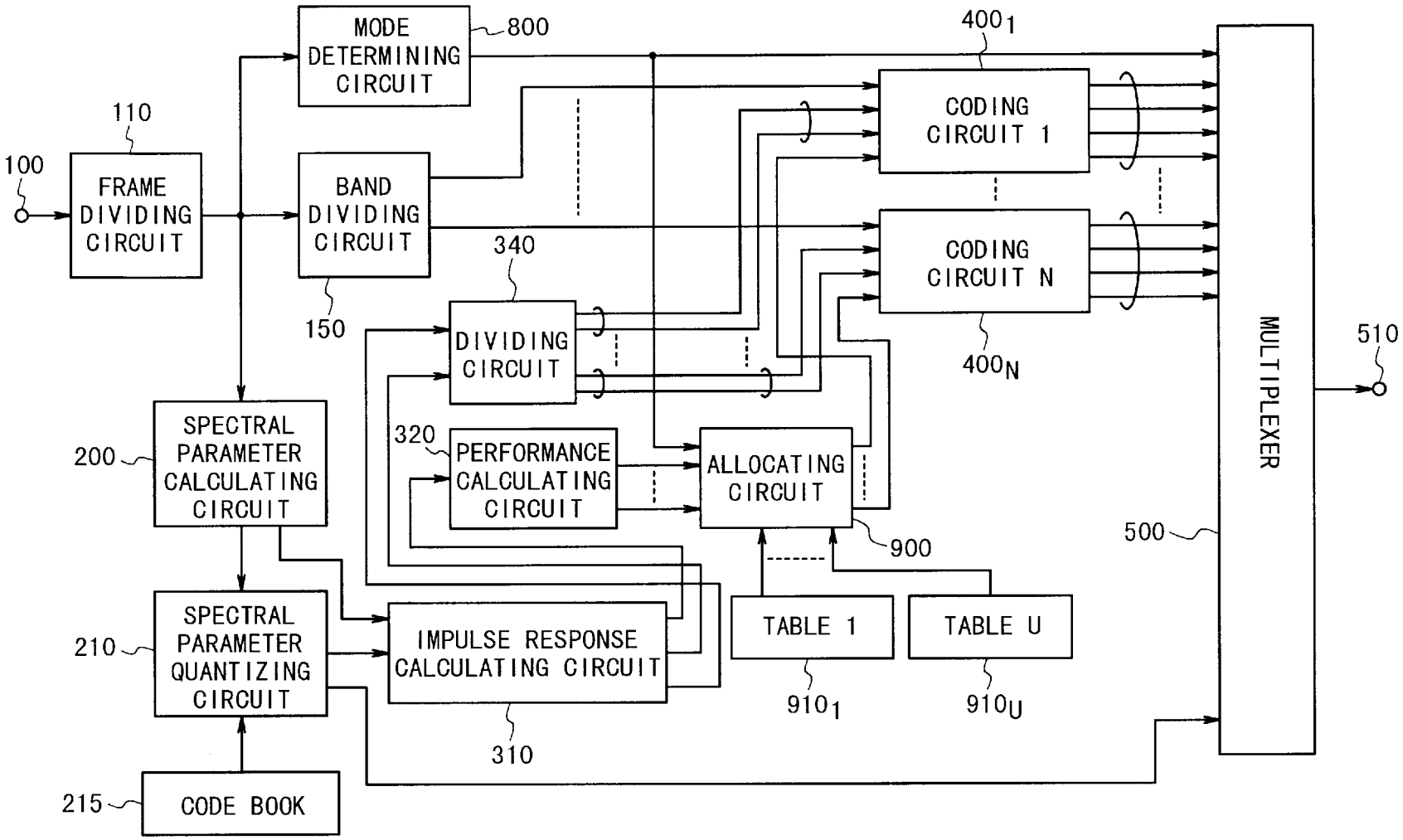
FIG. 15 is a block diagram illustrating a signal coding apparatus according to the ninth embodiment of the present invention.

FIG. 15 is a schematic block diagram for illustrating the structure of the signal coding apparatus according to the ninth embodiment of the present invention. In the ninth embodiment, an allocating circuit 900 inputs therein mode determining information from a mode determining circuit 900. The allocating circuit 900 previously forms tables for representing a relationship between the number of pulses and S/N performance with respect to each band. These tables are from $\mathbf{910}_1$ to $\mathbf{910}_U$. For instance, for each band with respect to a large amount of signals, an averaged S/N is previously measured while the number of pulses is changed. Then, this averaged S/N is stored into the table corresponding to the band. Note that the symbol "U" means the number of modes.

When an SMR(t) for the band "t" is inputted from the performance calculating circuit 320, and further the mode information of the frame is inputted from the mode determining circuit 800, the table to be referred to is selected in accordance with the mode information and the number of pulses is allocated so as to satisfy this request value.

A specific process operation is given as follows. That is, first assuming now that the number of pulse for each of the bands is set to be 1, an SNR(t) for the band "t" is determined from the table for the mode U. Then, the $MNR_u(t)$ is calculated by the following equation (40).

$$MNR_U(t) = SNR_U(t) - SMR(t) \text{[dB]} \tag{40}$$

A total of the numbers of bits for all of the bands is calculated, and the allowable number of bits is calculated. In a band in which $MNR_U(t)$ has a minimum, the number of pulses is incremented by "1" to correct the value of SNR(t), and then the allowable number of bits is again calculated. These calculations are repeated. That is, these process operations are repeated unless the allowable number of bits becomes negative.

It should also be noted that also in the coding circuits $\mathbf{400}_1$ to $\mathbf{400}_N$, the operations of the adaptive code book and the gain code book may be switched by using the mode determining information. Further, the code book 215 may be switched by using the mode determining information even in the spectral parameter quantizing circuit 210.

Figure 16:
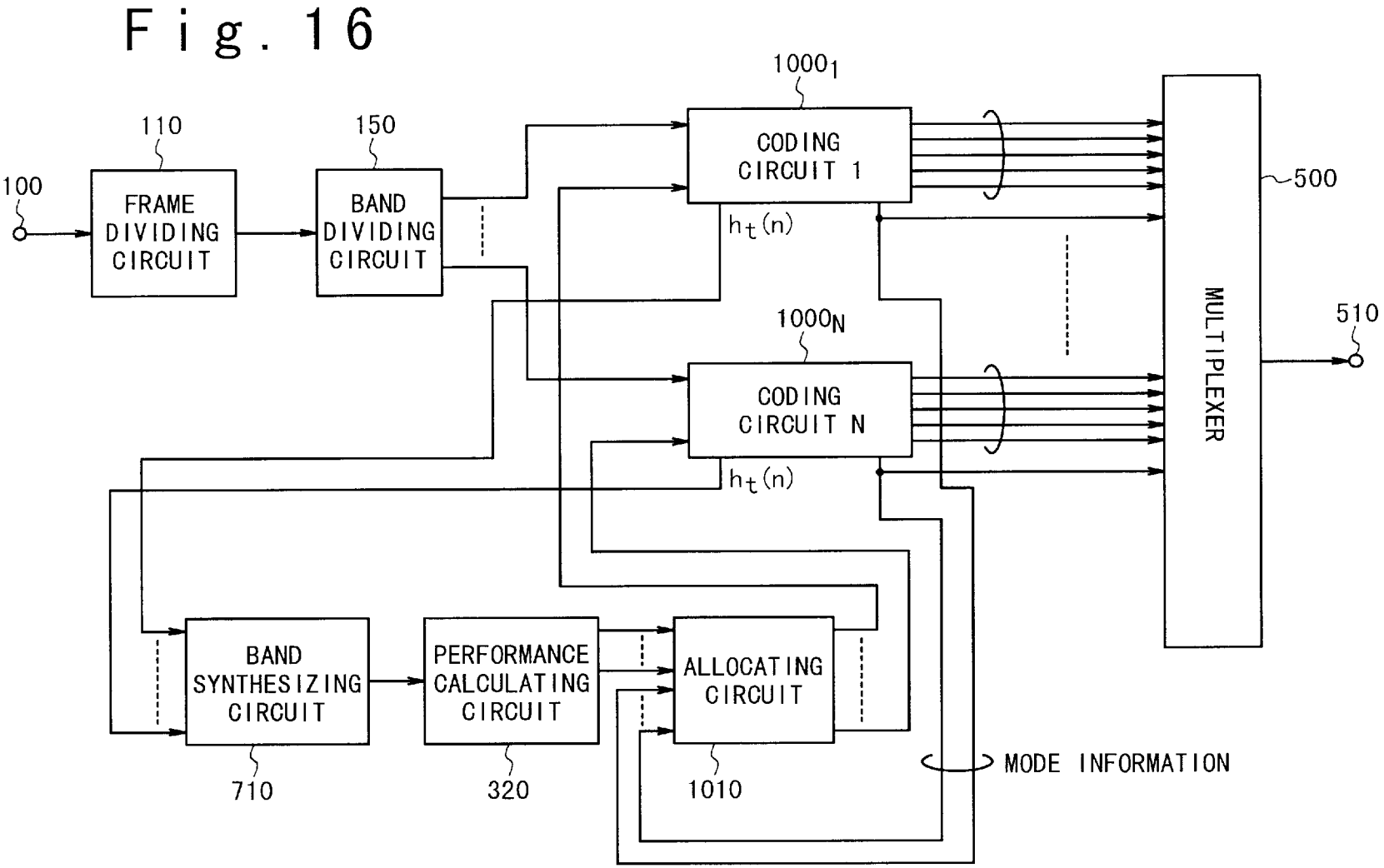
FIG. 16 is a block diagram illustrating a signal coding apparatus according to the tenth embodiment of the present invention.

FIG. 16 is a block diagram for representing the structure of the signal coding apparatus according to the tenth embodiment of the present invention. In the tenth embodiment of the present invention, an input signal is divided into a plurality of bands for every predetermined frame, and a spectral parameter (for example, LPC coefficients) representative of a spectral envelop is calculated from the band divided signal. A feature amount is extracted from the band divided signal to determine a mode, and a performance request value is determined for each of the bands based on the spectral parameter. The number of pulses for representing the excitation signal is adaptively allocated to each of the bands in accordance with the performance request value.

Referring now to FIG. 16, an allocating circuit 1010 enters therein the mode information of the respective bands from the respective coding circuits $\mathbf{1000}_1$ to $\mathbf{1000}_N$, and allocates the number of pulses for each of the bands. The allocating circuit 1010 adaptively allocates the number of pulses for every band in accordance with SMR(t) and the mode information.

As a simple allocation example, assuming now that the coding S/N (signal-to-noise ratio) per 1 pulse is A [dB], SMR(t) is divided by $A_U(t)$ to calculate the necessary number of pulses. As described above, the allocated numbers of pulses are calculated for the respective bands, and then are outputted to the coding circuits $\mathbf{1000}_1$ to $\mathbf{1000}_N$ in the above-described manner. It should be noted that when the allocation of the number of pulses is carried out, a total number of transfer bits B is calculated by summing the number of bits over all the band, and the number of pulses is controlled so as to satisfy B=R. In this case, the symbol "R" indicates a predetermined transfer rate. Also, the following equation (41) is satisfied.

$$B = \sum_{i=t}^{N} b_U(t) \tag{41}$$

where the symbol $b_U(t)$ indicates the number of transfer bits for the band "t" in the mode U calcuated from the allocated number of pulses for the band "t" in the mode U and other transfer bit information, and the symbol "N" represents the number of bands. With employment of such a structure, it is possible to achieve the allocation of the number of pulses with higher precision for every band and every mode.

Figure 17:
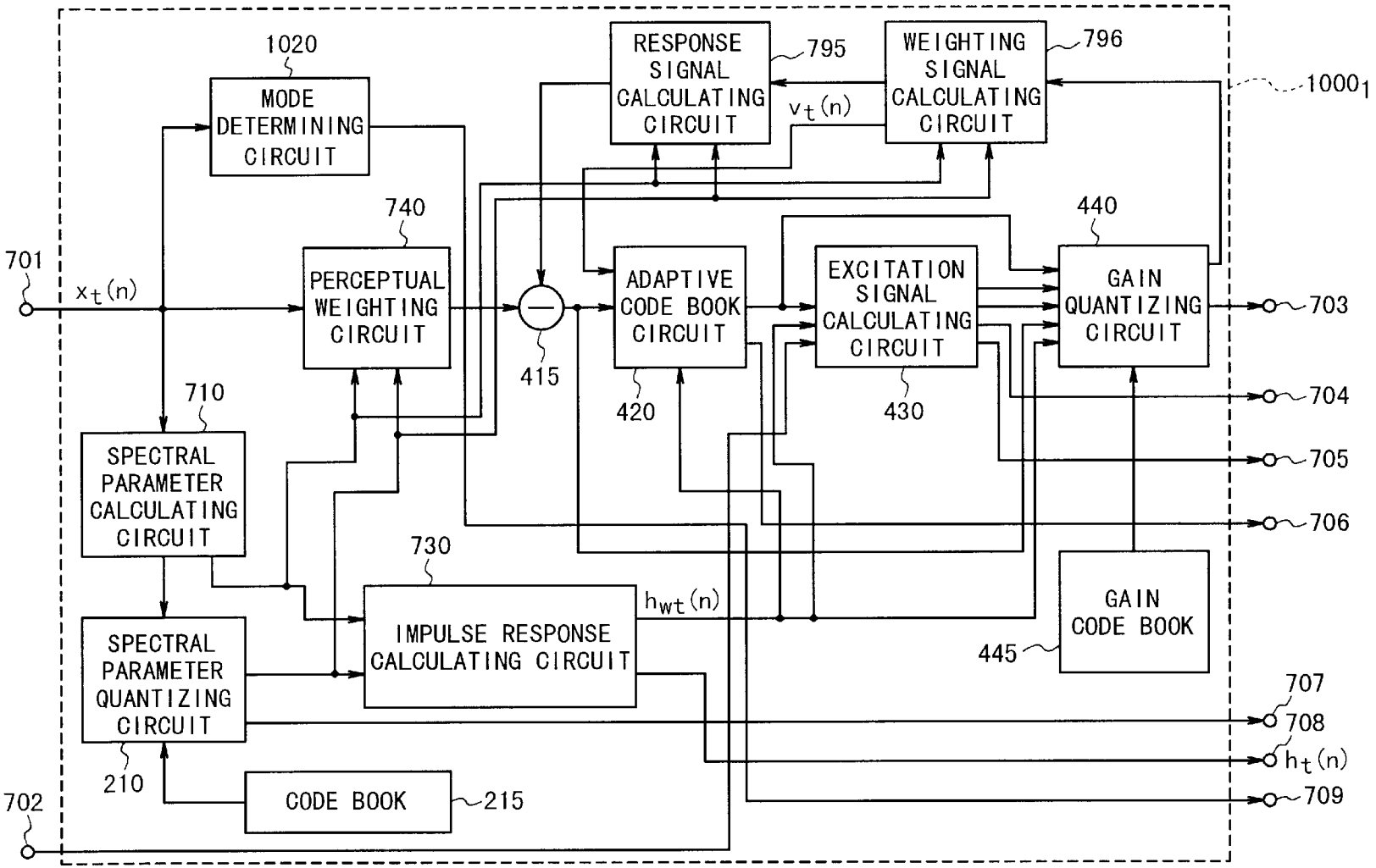
FIG. 17 is a block diagram illustrating a coding circuit $\mathbf{1000}_1$ of the signal coding apparatus according to the tenth embodiment of the present invention.

Referring now to FIG. 17, the structures of the coding circuits $\mathbf{1000}_1$ to $\mathbf{1000}_N$ will be described. It should be understood that since the coding circuits $\mathbf{1000}_1$ to $\mathbf{1000}_N$ has the same structure, a description will now be made of the structure of the typical coding circuit-1 $\mathbf{1000}_1$. Referring to FIG. 17, a mode determining circuit 1020 receives an input signal for the band "t" in units of the frames from a terminal 701, and outputs the mode information to a terminal 1021. In this case, a feature amount of the current frame is used to determine one of modes. As the feature amount, for example, a pitch prediction gain averaged over the current frame is used. The pitch prediction gain is calculated by using, for instance, the following equation (42).

$$G = 10 \log_{10}\left[\frac{1}{L}\sum_{i=1}^{L}\left(\frac{P_i}{E_i}\right)\right] \tag{42}$$

where the symbol "L" indicates the number of sub-frames contained in the frame. It should be noted that "L" may be selected to be 1. The symbols $P_i$ and $E_i$ denote speech power and pitch prediction error power in the i-th sub-frame, respectively, and are given by the following equations (43) and (44).

$$P_i = \sum_{n=0}^{N-1} x_t^2(n) \tag{43}$$

$$E_i = P_i - \frac{\left[\sum_{n=0}^{N-1} x_t(n)x_t(n-T_i)\right]^2}{\sum_{n=0}^{N-1} x_t^2(n-T_i)} \tag{44}$$

where the symbol "$T_t$" indicates an optimum delay capable of maximizing a prediction gain for the band t. The frame-averaged pitch prediction gain G is compared with either one threshold value or a plurality of threshold values, which are predetermined, and then one of the plurality of modes is selected. For instance, four modes may be employed.

Figure 18:
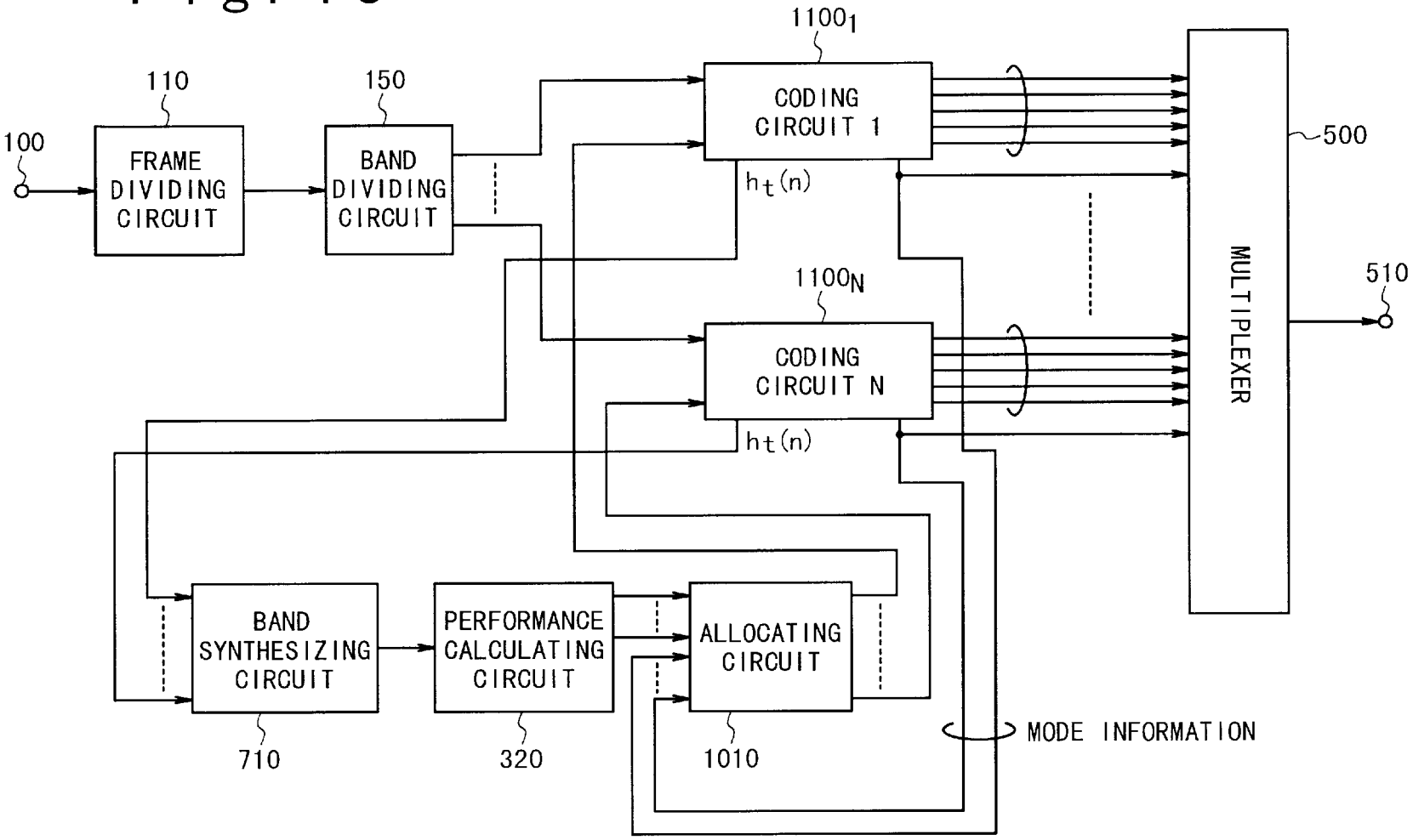
FIG. 18 is a block diagram illustrating a signal coding apparatus according to the eleventh embodiment of the present invention.
Figure 19:
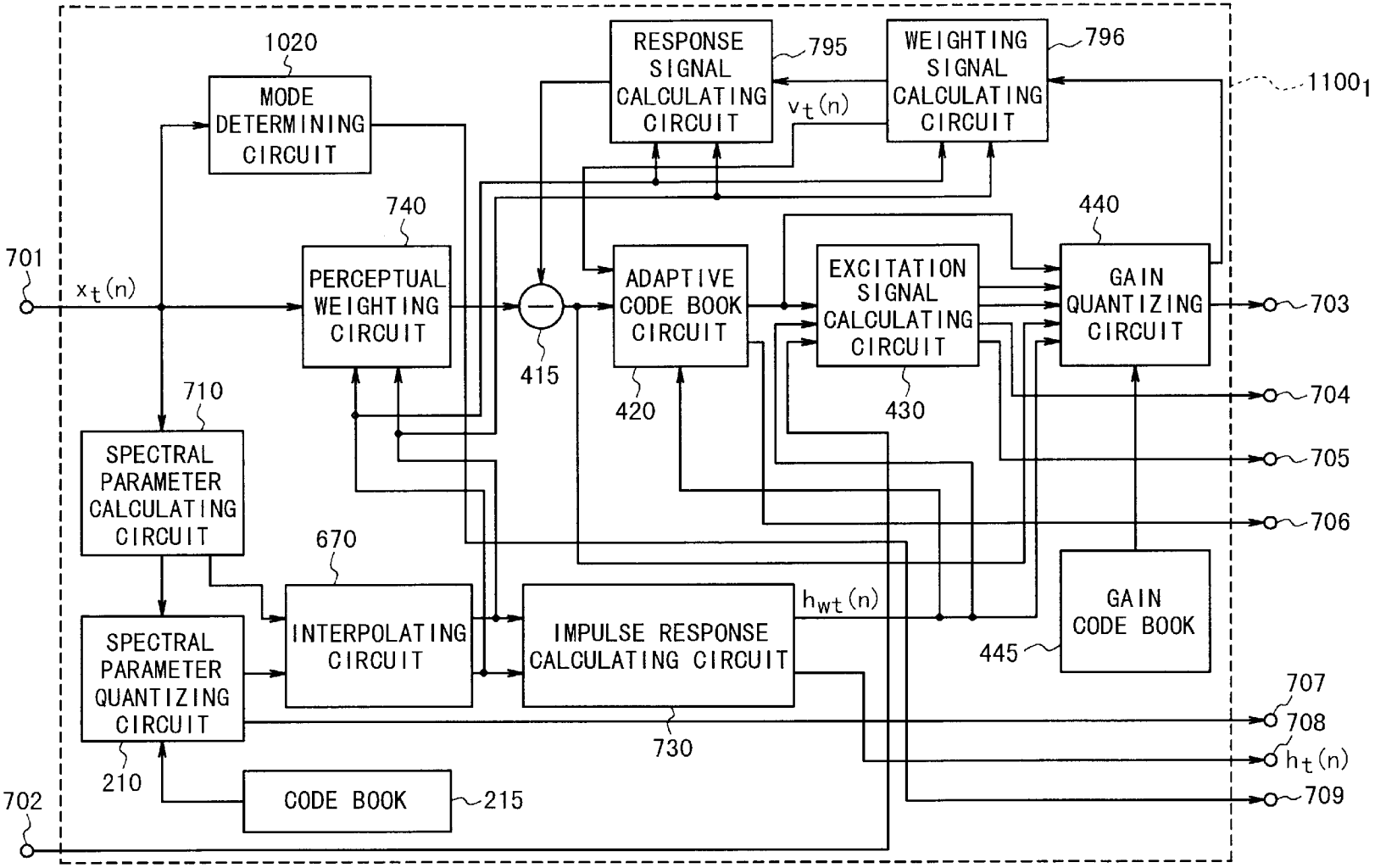
FIG. 19 is a block diagram illustrating a coding circuit $\mathbf{1000}_1$ of the signal coding apparatus according to the eleventh embodiment of the present invention.

FIG. 18 is a schematic block diagram for illustrating the structure of the signal coding apparatus according to the eleventh embodiment of the present invention. Since the structures of the coding circuits $\mathbf{1100}_1$ to $\mathbf{1100}_N$ are different from those of FIG. 16, the arrangement of the coding circuit $\mathbf{1000}_1$ is represented in FIG. 19. A different point between FIG. 19 and FIG. 17 is to additionally provide with an interpolating circuit 670.

Figure 20:
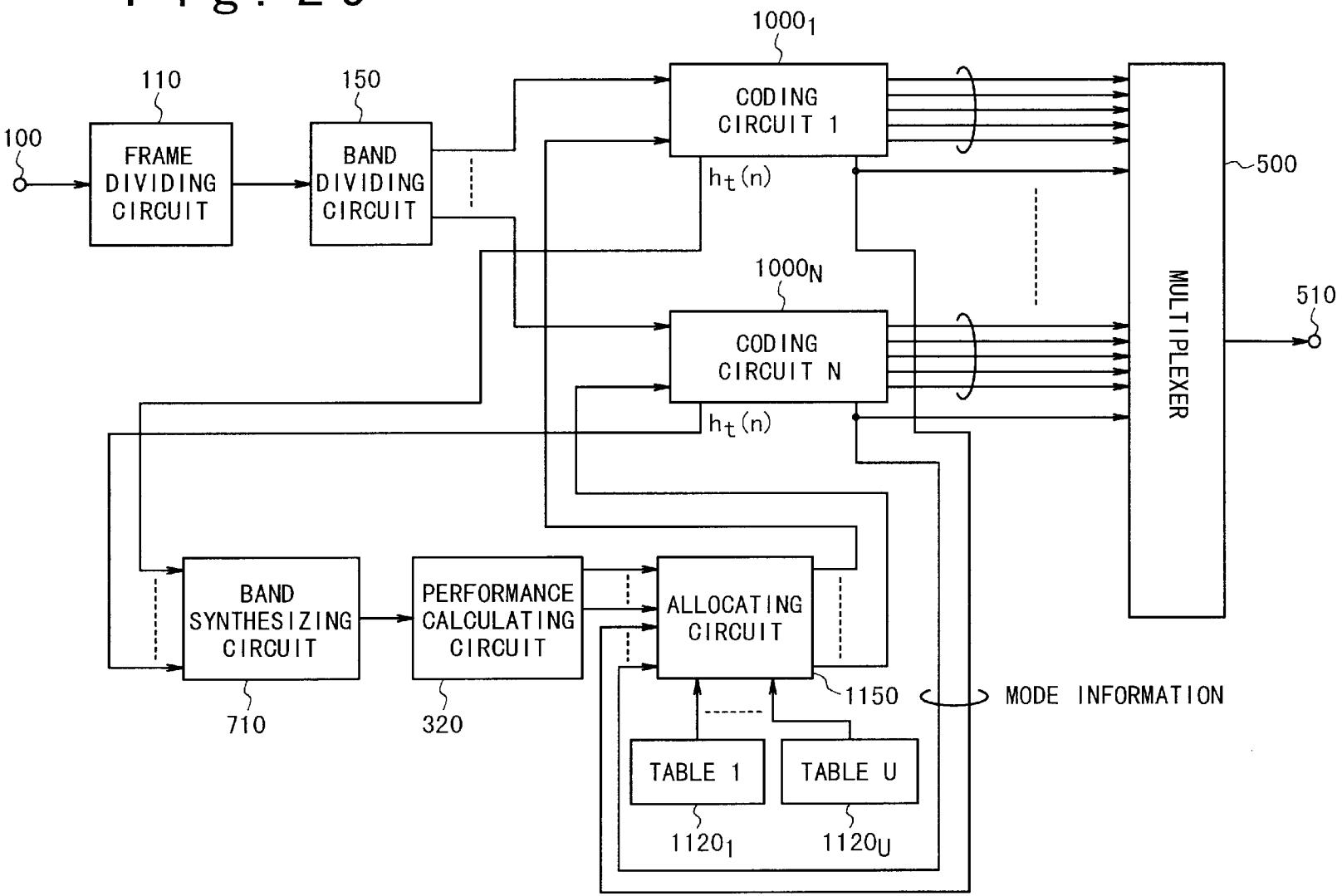
FIG. 20 is a block diagram illustrating a signal coding apparatus according to the twelfth embodiment of the present invention.

FIG. 20 is a schematic block diagram for illustrating the structure of the signal coding apparatus according to the twelfth embodiment of the present invention. In the twelfth embodiment of the present invention, a table which indicates a relation of the number of pulses and performance in the tenth embodiment is previously provided for each of the bands and the number of pulses is adaptively allocated to each of the bands using the performance request value and the table.

An allocating circuit 1150 previously forms a table indicative of a relation between the number of pulses and the S/N performance for each of the modes. These tables are defined as a table $\mathbf{1120}_1$ to a table $\mathbf{1120}_U$. In this case, the symbol U indicates the number of modes. For instance, using a large amount of signals, an averaged S/N is previously measured while the number of pulses is changed for each band and for each mode. Then, this averaged S/N is stored into the tables for every band and for every mode.

When an SMR(t) for the band "t" is inputted from the performance calculating circuit 320, the mode determining information for every band is further inputted from a corresponding one of the coding circuits $\mathbf{1000}_1$ to $\mathbf{1000}_N$, one of the tables to be referred to is switched in accordance with each of the modes, and then the number of pulses is allocated so as to satisfy this request value of SMR(t). A more specific process operation will now be described as follows.

That is, first, assuming now that the number of pulse for each of the bands is set to be 1, an $SNR_U(t)$ for the band "t" is determined from the table for the mode U. The $MNR_U(t)$ is calculated by the following equation (45).

$$MNR_U(t) = SNR_U(t) - SMR(t)\,[\text{dB}] \tag{45}$$

A total of the numbers of bits is determined for all of the bands, and the allowable number of bit is calculated.

In the band in which MNR has a minimum, the number of pulses is incremented by "1" to correct the value of $SNR_U(t)$, so that the allowable number of bits is again calculated. These calculations are repeated. That is, these process operations are repeated unless the allowable number of bits becomes negative.

In each of the above-described embodiments, the amplitudes of the pulses are expressed by using the polarities in the excitation signal calculating circuit. However, alternatively, a plurality of amplitudes may be entirely vector-quantized, so that the performance may be furthermore improved.

In addition, if the amplitude vector-quantizing code book may be combined with the positions so as to be searched with respect to a plurality of sets of position, an optimum combination may be selected, resulting in further improvements of the performance.

A specific example will now be described. For the sake of a simple explanation, two sets of positions of M pulses will be calculated. First, with the first set of pulse positions, amplitude code vectors are read out from the amplitude code books and one of the read amplitude code vectors is selected so as to minimize distortion, and then the first distortion $D_1$ is calculated. Subsequently, with the second set of pulse positions, amplitude code vectors are read out from the amplitude code book. Then, the same processing as described above is repeatedly performed. As a result, the second distortion $D_2$ is calculated. Thereafter, the first distortion $D_1$ is compared with the second distortion $D_2$, and then a combination of a position and an amplitude code vector is selected to gives smaller distortion.

As described above, according to the present invention, the excitation signal is represented by a plurality of pulses, so that the amount of necessary calculation can be reduced.

Also, in accordance with the present invention, the spectral parameter is derived from either the input signal, or the band-divided signal. Based upon this spectral parameter, the performance request values are preferably calculated from the calculations of the signal-to-masking threshold value for a plurality of bands. Then, the numbers of pulses are adaptively allocated to the respective bands in accordance with the calculated performance request values. As a consequence, it is possible to achieve better sound quality even in music signals having irregularly changeable characteristics. Also, there is such an advantage that the information required to adaptively allocate the numbers of pulses must be no longer transmitted.

Furthermore, according to the present invention, the spectral parameter is interpolated for every sub-frame which is shorter than the length of the frame, so that the pulses can be smoothly allocated in view of temporal matters.

Then, in accordance with the present invention, the a table indicative of the relation between the number of pulses and the performance is previously provided, and the allocation of the number of pulses is adaptively performed by using the table. As a result, the allocation of the number of pulses can be simply performed with high precision.

Furthermore, according to the present invention, the mode determination is carried out based upon either the input signal or the band-divided signal, and then the allocation of the number of pulses is adaptively performed for every band by additionally utilizing this mode information. Accordingly, the precision of the allocation of the number of pulses can be further improved, resulting in improvements of sound qualities. This allocation of the number of pulses for each of the bands may be carried out by switching tables in accordance with each of the modes, resulting in a simple process operation.

What is claimed is:

1. A signal coding apparatus comprising:

signal dividing means for dividing an input sound signal in units of frames and in units of bands to generate a frame signal for each frame and for the bands and a band frame signal for each frame and for each band;

pulse allocating means for determining a performance request value for each of the bands and a band control signal from the frame signal, for determining a number of pulses for each of the bands from the performance request value for the band, and for adaptively allocating the determined numbers of pulses to the bands for every frame; and a plurality of coding circuits respectively provided for the bands, wherein each of said plurality of coding circuits generates a transmission signal for a corresponding band for every frame from the band frame signal and the band control signal based on the number of pulses allocated to the corresponding band.

2. A signal coding apparatus according to claim 1, wherein said pulse allocating means comprises:

spectral parameter means for calculating a first spectral parameter of said frame signal, quantizing the spectral parameter of said frame signal to determine an index of the quantized spectral parameter, and for inversely quantizing the quantized spectral parameter to generate a second spectral parameter;

impulse response calculating means for calculating first to third impulse responses from the first and second spectral parameters, and for supplying the band control signal generated from said first and second impulse responses to each of said plurality of coding circuits;

performance calculating means for calculating a performance request value for each of the bands from the third impulse response as an impulse response of a synthesis filter; and allocating means for determining the numbers of pulses for the bands from the performance request values for the bands to adaptively and respectively allocate the number of pulses to said plurality of coding circuits for every frame.

3. A signal coding apparatus according to claim 2, wherein said pulse allocating means further comprises an interpolating circuit for interpolating the first and second spectral parameters supplied from said spectral parameter means for every sub-frame which is shorter than a length of one frame to supply to said impulse response calculating circuit.

4. A signal coding apparatus according to claim 2, wherein said impulse response calculating means comprises:

an impulse response calculating circuit for generating the first to third impulse responses from the first and second spectral parameters; and a dividing circuit for generating the band control signal for each of the bands from first and second impulse responses as impulse responses of perceptually weighting filters from said impulse response calculating means to output to each of said plurality of coding circuits corresponding to the band.

5. A signal coding apparatus according to claim 2, wherein said impulse response calculating means comprises:

an impulse response calculating circuit for generating the first to third impulse responses from the first and second spectral parameters;

a dividing circuit for generating first and second band impulse response for each of the bands from first and second impulse responses as impulse responses of perceptually weighting filters from said impulse response calculating means; and an LPC analysis circuit for receiving the first and second band impulse responses from said dividing circuit to calculate auto-correlation function values and for calculating first and second linear prediction coefficients from the auto-correlation function values the band control signal.

6. A signal coding apparatus according to claim 2, wherein said allocating means comprises:

a table for storing data indicating a relation of the performance request value and the number of pulses; and an allocating circuit for referring to said table in accordance with the performance request value for each of the bands supplied from said performance calculating means to determine the number of pulses for each of the bands, and for determining and allocating the optimal numbers of pulses for the bands to said plurality of coding circuits.

7. A signal coding apparatus according to claim 2, further comprising mode determining means for extracting a feature of said frame signal from said frame signal supplied from said signal dividing means to determine one of modes, and wherein said pulse allocating means determines a performance request value for each of the bands and a band control signal from the frame signal, determines a number of pulses for each of the bands from the performance request value for the band and the determined mode, and adaptively allocates the determined numbers of pulses to the bands for every frame.

8. A signal coding apparatus according to claim 7, wherein said allocating means comprises:

a plurality of tables respectively provided for the modes, wherein each of said plurality of tables stores data indicating a relation of the performance request value and the number of pulses; and an allocating circuit for selecting one of said plurality of tables in accordance with the determined mode, for referring to said selected table in accordance with the performance request value for each of the bands supplied from said performance calculating means to determine the number of pulses for each of the bands, and for determining and allocating the optimal numbers of pulses for the bands to said plurality of coding circuits.

9. A signal coding apparatus according to claim 2, wherein each of said plurality of coding circuits comprises:

a perceptual weighting circuit for perceptually weighting a corresponding band frame signal in accordance with said band control signal to produce a perceptually weighting signal;

a response signal calculating circuit for receiving indexes of a gain and delay of an adaptive code book, indexes of amplitudes and positions of an excitation signal, an index of a gain code book and said band control signal to calculate a drive excitation signal and to calculate a response signal from the drive excitation signal;

a subtracter for subtracting the response signal supplied from said response signal calculating circuit from the perceptually weighting signal to produce a subtracted signal;

an adaptive code book circuit for receiving the subtracted signal from said subtracter, the drive excitation signal from said response signal calculating circuit, and the band control signal to determine an index indicating a delay and to perform a pitch prediction for determining a prediction remaining signal;

an excitation signal calculating circuit for determining the amplitudes and positions of the excitation signal from the prediction remaining signal supplied from said adaptive code book circuit and the band control signal in accordance with the number of pulses allocated to the band to generate the indexes of the amplitudes and positions of the excitation signal;

a gain code book for storing gain code vectors; and a gain quantizing circuit for receiving the subtracted signal from said subtracter, the prediction remaining signal from said adaptive code book circuit, the amplitudes and positions of the excitation signal from said excitation signal calculating circuit, and the band control signal to refer to said gain code book for determining the index of the gain of the gain code book and the index of the gain of the adaptive code book, and for supplying the indexes of the gain and delay of the adaptive code book, the indexes of the amplitudes and positions of the excitation signal, and the index of the gain of the gain code book.

10. A signal coding apparatus according to claim 1, further comprising mode determining means for extracting a feature of said frame signal from said frame signal supplied from said signal dividing means to determine one of modes, and wherein said pulse allocating means determines a performance request value for each of the bands and a band control signal from the frame signal, determines a number of pulses for each of the bands from the performance request value for the band and the determined mode, and adaptively allocates the determined numbers of pulses to the bands for every frame.

11. A signal coding apparatus comprising:

signal dividing means for dividing an input sound signal in units of frames and in units of bands to generate a band frame signal for each frame and for each band;

pulse allocating means for determining a performance request value for each of the bands from a band impulse response for each of the bands, for determining a number of pulses for each of the bands from the performance request value for the band, and for adaptively allocating the determined numbers of pulses to the bands for every frame; and a plurality of coding circuits respectively provided for the bands, wherein each of said plurality of coding circuits generates a transmission signal for a corresponding band for every frame and the band impulse response for the corresponding band from the band frame signal based on the number of pulses allocated to the corresponding band.

12. A signal coding apparatus according to claim 11, wherein each of said plurality of coding circuits comprises:

spectral parameter means for calculating a first spectral parameter of said frame signal, quantizing the spectral parameter of said frame signal to determine an index of the quantized spectral parameter, and for inversely quantizing the quantized spectral parameter to generate a second spectral parameter;

impulse response calculating means for calculating the band impulse response and a band control signal from the first and second spectral parameters;

a perceptual weighting circuit for perceptually weighting a corresponding band frame signal in accordance with the first and second spectral parameters to produce a perceptually weighting signal;

a response signal calculating circuit for calculating a second response signal from a first response signal, and the first and second spectral parameters;

a subtracter for subtracting the second response signal supplied from said response signal calculating circuit from the perceptually weighting signal to produce a subtracted signal;

an adaptive code book circuit for receiving the subtracted signal from said subtracter, a drive excitation signal, and the band control signal to determine an index indicating a delay and to perform a pitch prediction for determining a prediction remaining signal;

an excitation signal calculating circuit for determining the amplitudes and positions of the excitation signal from the prediction remaining signal supplied from said adaptive code book circuit and the band control signal in accordance with the number of pulses allocated to the band to generate the indexes of the amplitudes and positions of the excitation signal;

a gain code book for storing gain code vectors;

a gain quantizing circuit for receiving the subtracted signal from said subtracter, the prediction remaining signal from said adaptive code book circuit, the amplitudes and positions of the excitation signal from said excitation signal calculating circuit, and the band control signal to refer to said gain code book for determining the index of the gain of the gain code book and the index of the gain of the adaptive code book, and for supplying the indexes of the gain and delay of the adaptive code book, the indexes of the amplitudes and positions of the excitation signal, and the index of the gain of the gain code book; and a weighting signal calculating circuit for receiving indexes of the gain and delay of the adaptive code book, the indexes of amplitudes and positions of the excitation signal, the index of the gain code book and the first and second spectral parameters to calculate the drive excitation signal and to calculate the first response signal from the drive excitation signal.

13. A signal coding apparatus according to claim 12, wherein each of said plurality of coding circuits further comprises an interpolating circuit for interpolating the first and second spectral parameters supplied from said spectral parameter means for every sub-frame which is shorter than a length of one frame to supply to said impulse response calculating circuit.

14. A signal coding apparatus according to claim 12, wherein each of said plurality of coding circuits further comprises mode determining means for extracting a feature of said frame signal from said frame signal supplied from said signal dividing means to determine one of modes, and wherein pulse allocating means determines the performance request value for each of the bands from the band impulse response for each of the band, determines the number of pulses for each of the bands from the performance request value for the band and the determined mode for each of the band, and adaptively allocates the determined numbers of pulses to the bands for every frame.

15. A signal coding apparatus according to claim 14, wherein each of said plurality of coding circuits further comprises an interpolating circuit for interpolating the first and second spectral parameters supplied from said spectral parameter means for every sub-frame which is shorter than a length of one frame to supply to said impulse response calculating circuit.

16. A signal coding apparatus according to claim 14, wherein said pulse allocating means includes:

band synthesizing means for synthesizing the band impulse responses over the bands to generate a synthesis signal;

performance calculating means for calculating a performance request value for each of the bands from the synthesis signal; and allocating means for determining the numbers of pulses for the bands from the performance request values for the bands to adaptively and respectively allocate the number of pulses to said plurality of coding circuits for every frame.

17. A signal coding apparatus according to claim 16, wherein said allocating means comprises:

a table for storing a data indicating a relation of the performance request value and the number of pulses; and an allocating circuit for referring to said table in accordance with the performance request value for each of the bands supplied from said performance calculating means to determine the number of pulses for each of the bands, and for determining and allocating the optimal numbers of pulses for the bands to said plurality of coding circuits.

18. A signal coding apparatus according to claim 16, wherein said allocating means comprises:

a plurality of tables respectively provided for the modes, wherein each of said plurality of tables stores a data indicating a relation of the performance request value and the number of pulses; and an allocating circuit for selecting one of said plurality of tables in accordance with the determined mode, for referring to said selected table in accordance with the performance request value for each of the bands supplied from said performance calculating means to determine the number of pulses for each of the bands, and for determining and allocating the optimal numbers of pulses for the bands to said plurality of coding circuits.

19. A signal coding apparatus according to claim 11, wherein said pulse allocating means includes:

band synthesizing means for synthesizing the band impulse responses over the bands to generate a synthesis signal;

performance calculating means for calculating a performance request value for each of the bands from the synthesis signal; and allocating means for determining the numbers of pulses for the bands from the performance request values for the bands to adaptively and respectively allocate the number of pulses to said plurality of coding circuits for every frame.

20. A signal coding apparatus according to claim 19, wherein said allocating means comprises:

a table for storing a data indicating a relation of the performance request value and the number of pulses; and an allocating circuit for referring to said table in accordance with the performance request value for each of the bands supplied from said performance calculating means to determine the number of pulses for each of the bands, and for determining and allocating the optimal numbers of pulses for the bands to said plurality of coding circuits.

21. A method of coding an input sound signal, comprising the steps of:

dividing the input sound signal in units of frames and in units of bands to generate a band frame signal;

determining a performance request value for each of the bands to determine a number of pulses for each of the bands from the performance request value for the band;

adaptively allocating the determined numbers of pulses to the bands for every frame; and generating a transmission signal for a corresponding band for every frame from the band frame signal based on the number of pulses allocated to the corresponding band.

22. A method according to claim 21, wherein said dividing step includes dividing the input sound signal in units of frames to generate a frame signal, and wherein said determining step includes determining the number of pulses for each of the bands from the frame signal.

23. A method according to claim 21, wherein said generating step includes generating a band impulse response for each of the bands, and wherein said determining step includes:

synthesizing the band impulse responses over the bands to generate a synthesis signal; and determining the number of pulses for each of the band from the synthesis signal.

24. A method according to claim 21, further comprising the step of extracting a feature of a frame signal obtained by dividing the input sound signal in units of frames to determine one of modes based on the feature, and wherein said determining step includes:

determining a performance request value for each of the bands; and determining a number of pulses for each of the bands from the performance request value for the band and the determined mode.

25. A method according to claim 21, wherein said generating step includes extracting a feature of the band frame signal obtained to determine one of band modes based on the feature, and wherein said determining step includes:

determining a performance request value for each of the bands;

determine a number of pulses for each of the bands from the performance request value for the band and the determined band modes for the bands.

* * * * *